US008391766B2

(12) United States Patent
Fukuhata

(10) Patent No.: US 8,391,766 B2
(45) Date of Patent: Mar. 5, 2013

(54) FIXING DEVICE AND IMAGE FORMING APPARATUS INCORPORATING SAME

(75) Inventor: Yoshihiro Fukuhata, Takarazuka (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

(21) Appl. No.: 12/873,628

(22) Filed: Sep. 1, 2010

(65) Prior Publication Data

US 2011/0052285 A1 Mar. 3, 2011

(30) Foreign Application Priority Data

Sep. 1, 2009 (JP) ..... 2009-201600
Sep. 24, 2009 (JP) ..... 2009-219076

(51) Int. Cl.
*G03G 15/20* (2006.01)

(52) U.S. Cl. ..... 399/333; 399/334

(58) Field of Classification Search ..... 399/69, 399/122, 320, 322, 328, 330, 331, 333, 334
See application file for complete search history.

(56) References Cited

U.S. PATENT DOCUMENTS

| | | | | |
|---|---|---|---|---|
| 5,450,181 | A * | 9/1995 | Tsukida et al. | 399/322 |
| 5,737,679 | A * | 4/1998 | Uehara et al. | 399/329 |
| 6,289,185 | B1 * | 9/2001 | Cahill | 399/69 |
| 7,664,447 | B2 | 2/2010 | Yagi et al. | |
| 2007/0223976 | A1 | 9/2007 | Yagi et al. | |
| 2008/0013992 | A1 | 1/2008 | Fukuhata et al. | |
| 2008/0013993 | A1 | 1/2008 | Obata et al. | |
| 2008/0063442 | A1 | 3/2008 | Yagi et al. | |
| 2008/0069611 | A1 | 3/2008 | Obata et al. | |
| 2010/0178089 | A1 | 7/2010 | Fukuhata | |
| 2010/0239297 | A1 | 9/2010 | Sakaya | |
| 2010/0260524 | A1 | 10/2010 | Hiraoka et al. | |
| 2010/0272481 | A1 | 10/2010 | Yamamoto et al. | |
| 2010/0296848 | A1 * | 11/2010 | Yamamoto et al. | 399/328 |
| 2012/0020690 | A1 * | 1/2012 | Yamamoto et al. | 399/69 |

FOREIGN PATENT DOCUMENTS

| | | |
|---|---|---|
| JP | 07-129014 | 5/1995 |
| JP | 2001-265146 | 9/2001 |
| JP | 2004-109697 | 4/2004 |

OTHER PUBLICATIONS

Machine translation of reference Goto et al. (JP 07-129,014 A), Listed in IDS. Pub date May 19, 1995.*
Machine translation of reference Hayamizu et al. (JP 2005-352,297 A) Pub date Dec. 22, 2005.*

* cited by examiner

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A fixing device includes a first member. The first member extends along a first longitudinal axis, and has an external surface whose thickness varies along the first longitudinal axis to define at least one first convex portion and at least one first concave portion. A thickness of the first convex portion is larger than a thickness of the first concave portion. A heating source is disposed in the first member. The heating temperature of an inner circumference side of the first convex portion is higher than the heating temperature of the inner circumference side of the first concave portion.

16 Claims, 12 Drawing Sheets

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Applications Nos. 2009-201600 and 2009-219076, filed on Sep. 1, 2009 and Sep. 24, 2009, respectively, which are hereby incorporated by reference herein in their entirety. The present application also incorporates by reference related Japanese Patent Application Nos. 2009-11232, 2009-005710 and 2009-079456, filed on Jan. 21, 2009, Jan. 14, 2009 and Mar. 27, 2009, respectively.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing device, which permanently fixes the toner image in place on the recording medium by melting and settling toner with heat and pressure.

Various types of fixing devices are known in the art, most of which employ a pair of parallel, elongated fixing members, at least one of which is heated and/or pressed against the other to define a line of contact called a fixing nip, through which a recording medium is passed under heat and pressure during the fixing process. Typical configurations of such fixing devices include a pair of cylindrical rollers, one internally heated and the other pressed against the heated one, and a combination of an internally heated cylindrical roller with a stationary member pressed against the heated roller through an endless looped belt.

FIG. 1 schematically illustrates a conventional fixing device employing an internally heated fuser roller 100 and a pressure roller 200 pressed together to form a fixing nip N therebetween.

As shown in FIG. 1, during operation, the fixing device rotates the fuser roller 100 counterclockwise and the pressure roller 200 clockwise in the drawing to feed a recording sheet S bearing a powder toner image T thereon along a sheet feed path A, which is, for example, tangent to the surfaces of the opposing rollers 100 and 200. As the sheet S enters the fixing nip N, the toner image T comes into contact with the heated surface of the fuser roller 100. At the fixing nip N, the fuser roller 100 melts toner particles with heat, while the pressure roller 200 promotes settling of the molten toner by pressing the sheet S against the fuser roller 100. The toner image T thus processed under heat and pressure then cools and solidifies and becomes fixed in place as the sheet S exits the fixing nip N to advance along the sheet feed path A.

One problem encountered by such an electrophotographic fixing device is that the recording sheet S deviates from the intended path A where the toner image T, melting and becoming tacky during fixing, adheres to the surface of the fuser roller 100 to lift, or tilt, the sheet S toward the roller 100 downstream of the fixing nip N. If the adhesion of molten toner is severe enough, it tilts a recording sheet S beyond a threshold tilt angle θ in an oblique direction B with respect to the proper sheet path A. The threshold tilt angle θ here indicates a maximum allowable tilt or deviation from the sheet feed path A with which the fixing device can separate a recording sheet S from the fuser roller 100 for forwarding it through the fixing nip N. Violating this threshold θ results in the sheet S wrapping around the fuser roller 100 to cause a jam at the fixing nip N.

To illustrate the tilt threshold in terms of a force F exerted on a recording sheet passing through the fixing nip N, proper sheet separation and forwarding occurs when the following inequality is satisfied:

$$F1<F2$$

where F1 represents strength of adhesion of molten toner to the surface of the fuser roller 100, and F2 represents a bending force required to tilt the recording sheet S beyond the threshold angle θ from the proper sheet path A. Typically, with the toner adhesion being fixed, using thicker and stiffer recording sheets and a fuser roller of smaller diameter results in greater threshold tilt angle θ' and a higher bending force F2 required to pass that threshold tilt angle θ'.

To simultaneously provide both adequate fixing and smooth sheet feeding, conventional fixing devices use toner with wax or some other release agent added thereto to obtain a smaller adhesion force F1, or employ a fuser roller of a smaller diameter to obtain a higher allowable bending force F2. However, such conventional approaches remain unsuccessful where the fixing device processes thin recording sheets which are less stiff and more ready to bend than normal copy sheets. That is, using a relatively thin recording sheet means an allowable bending force F2 lower than that normally accommodated, which makes it difficult for the conventional fixing device to provide proper sheet feeding without wraparound and concomitant sheet jam at the fixing nip.

Another problem associated with an electrophotographic fixing device is the difficulty in maintaining a uniform pressure distribution throughout a fixing nip. This is particularly true where the fixing device uses a precisely cylindrical fixing roller in conjunction with an axially tapered, symmetrical fixing roller that has a diameter greatest at the center and smallest at each end (a "crowned" configuration), or conversely, greatest at each end and smallest at the center (a "bowed" configuration), which enables proper sheet feeding at relatively high speeds through the fixing nip. When juxtaposed and pressed against each other, a tapered roller and a cylindrical roller contact each other at higher pressures where the tapered roller diameter is greatest and at lower pressures where the tapered roller diameter is smallest, resulting in variation in nip pressure along the fixing nip.

It is known that variation in nip pressure translates into variation in gloss of a resulting image. That is, a printed image will be low in gloss where it is processed at relatively low pressures and high in gloss where it is processed at relatively high pressures. Such variation in gloss can detract from the appearance of the image, which is not acceptable for applications in today's high quality image forming apparatuses.

Hence, there is a need for an electrophotographic fixing device that employs a pair of fixing members defining a fixing nip therebetween, through which a recording medium can go through fixing process under a uniform pressure without wrapping around the fixing member to provide high quality printing with uniform gloss across the entire resulting image.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a first member and a second member. The first member extends along a first longitudinal axis. The thickness of the first member varies along the first longitudinal axis to define at least one first convex portion curving outward and at least one first concave portion curving inward with respect to the first longitudinal axis. The second member extends along a second longitudinal axis parallel to the first longitudinal axis, and has the thickness varies along the second longitudinal axis to define at least one second convex portion curving outward and at least one second concave portion curving inward with respect to the second longitudinal axis. At least one of the first and second members is heated, and at least one of the first and second members is pressed against the other, with the first convex portion engaging the second concave portion and the first concave portion engaging the second convex portion, to define a fixing nip therebetween through which the recording medium is passed to fix the toner image under heat and pressure.

Other exemplary aspects of the present invention are put forward in view of the above-described circumstances, and provide a novel image forming apparatus.

In one exemplary embodiment, the novel image forming apparatus includes an electrophotographic mechanism and a fixing unit. The electrophotographic mechanism forms a toner image on a recording medium. The fixing unit fixes the toner image in place on the recording medium. The fixing unit includes a first member and a second member. The first member extends along a first longitudinal axis. The thickness of the first member varies along the first longitudinal axis to define at least one first convex portion curving outward and at least one first concave portion curving inward with respect to the first longitudinal axis. The second member extends along a second longitudinal axis parallel to the first longitudinal axis, and has a second elastic layer whose thickness varies along the second longitudinal axis to define at least one second convex portion curving outward and at least one second concave portion curving inward with respect to the second longitudinal axis. At least one of the first and second members is heated, and at least one of the first and second members is pressed against the other, with the first convex portion engaging the second concave portion and the first concave portion engaging the second convex portion, to define a fixing nip therebetween through which the recording medium is passed to fix the toner image under heat and pressure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 22 illustrates reduction indifferences in the surface temperature between the crown portion (convex portion) and the inverted-crown portion (concave portion) in an illustrative embodiment of the present invention; and.

DETAILED DESCRIPTION OF PREFERRED EMBODIMENTS

Figure 1:
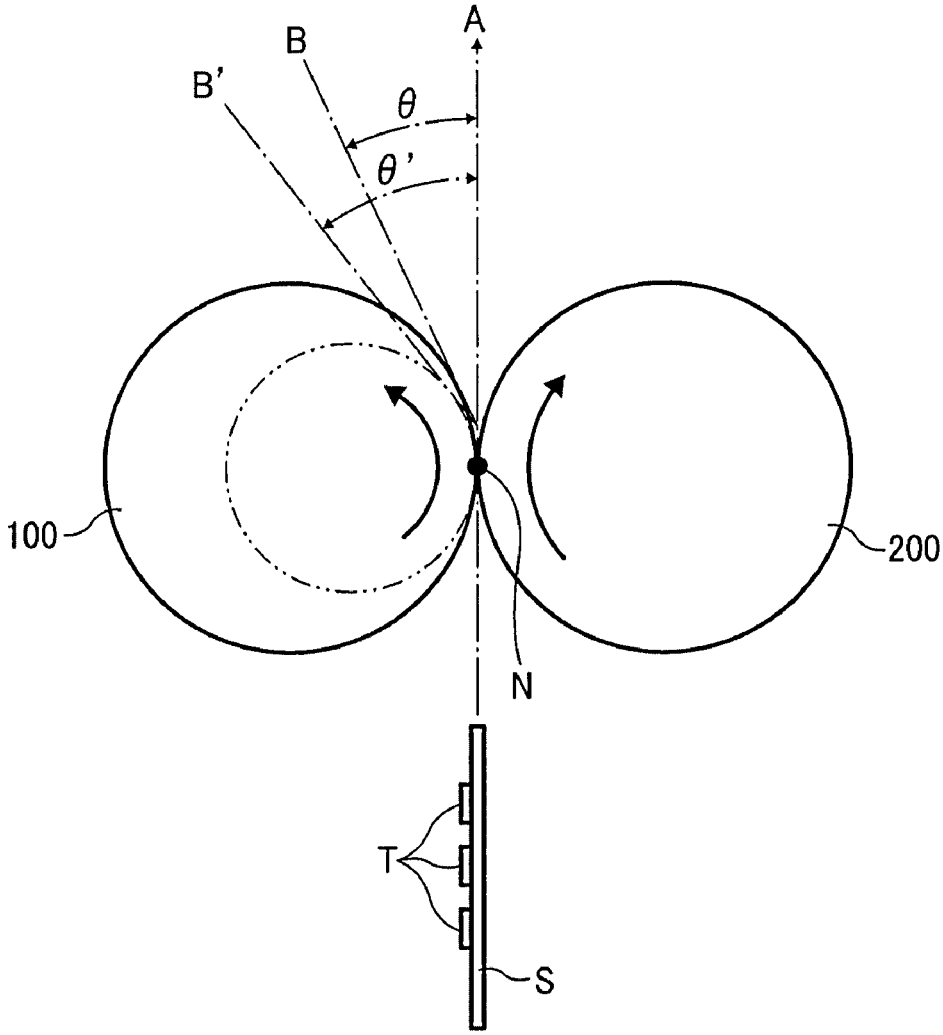
FIG. 1 schematically illustrates a conventional fixing device employing an internally heated fuser roller and a pressure roller.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments are described.

Figure 2:
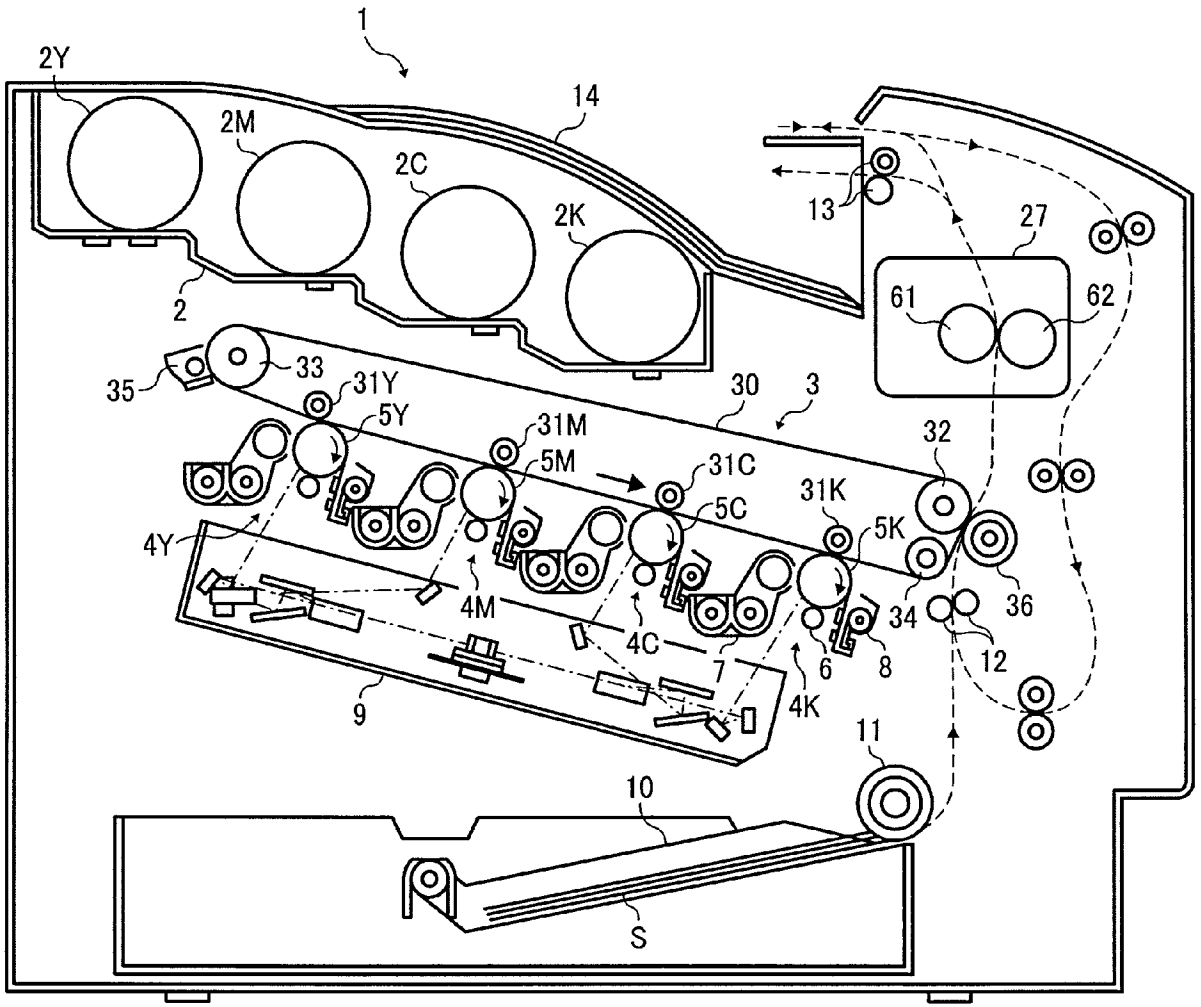
FIG. 2 schematically illustrates an example of an image forming apparatus incorporating a fixing device.

FIG. 2 schematically illustrates an example of an image forming apparatus 1 incorporating a fixing device 27.

As shown in FIG. 2, the image forming apparatus 1 is a tandem color printer including four imaging stations 4Y, 4M, 4C, and 4K arranged in series along the length of an intermediate transfer unit 3 and adjacent to a write scanner 9, which together form an electrophotographic mechanism to form an image with toner particles on a recording medium such as a sheet of paper S. The image forming apparatus 1 also includes a feed roller 11, a pair of registration rollers 12, and a pair of ejection rollers 13 together defining a sheet feed path, indicated by dotted arrows in the drawing, along which a recording sheet S advances toward an output tray 14 atop the apparatus 1 from a sheet feed tray 10 accommodating a stack of recording sheets at the bottom of the apparatus 1 through the fixing device 27.

In the image forming apparatus 1, each imaging unit (indicated collectively by the reference numeral 4) has a drum-shaped photoconductor 5 surrounded by a charging device 6, a development device 7, a cleaning device 8, a discharging device, not shown, etc., which work in cooperation to form a toner image of a particular primary color, as designated by the suffix letters, "Y" for yellow, "M" for magenta, "C" for cyan, and "K" for black. The imaging units 4Y, 4M, 4C, and 4K are supplied with toner from replaceable toner bottles 2Y, 2M, 2C, and 2K, respectively, accommodated in a toner supply 20 in the upper portion of the apparatus 1.

The intermediate transfer unit 3 includes an intermediate transfer belt 30, four primary transfer rollers 31Y, 31M, 31C, and 31K, and a belt cleaner 35, as well as a transfer backup roller or drive roller 32, a cleaning backup roller 33, and a tension roller 34 around which the intermediate transfer belt 30 is entrained. When driven by the roller 32, the intermediate transfer belt 30 travels counterclockwise in the drawing along an endless travel path, passing through four primary transfer nips defined between the primary transfer rollers 31 and the corresponding photoconductive drums 5, as well as a secondary transfer nip defined between the transfer backup roller 32 and a secondary transfer roller 36.

The fixing device 27 includes a pair of first and second fixing members 61 and 62, one being heated and the other being pressed against the heated one, to form a fixing nip N therebetween in the sheet feed path. Detailed description of several embodiments of the fixing device 27 will be given with reference to FIG. 3 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 6 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image into visible form using toner. The toner image thus obtained is forwarded to the primary transfer nip between the intermediate transfer belt 30 and the primary transfer roller 5.

At the primary transfer nip, the primary transfer roller 31 applies a bias voltage of a polarity opposite that of toner to the intermediate transfer belt 30. This electrostatically transfers the toner image from the photoconductive surface to an outer surface of the belt 30, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 30.

After primary transfer, the photoconductive surface enters the cleaning device 8 to remove residual toner by scraping off with a cleaning blade, and then to the discharging device to remove residual charges for completion of one imaging cycle. At the same time, the intermediate transfer belt 30 forwards the multicolor image to the secondary transfer nip between the transfer backup roller 32 and the secondary transfer roller 36.

In the sheet feed path, the feed roller 11 rotates counterclockwise in the drawing to introduce a recording sheet S from the sheet tray 10 toward the pair of registration rollers 12. The registration rollers 12 hold the fed sheet S, and then advance it in sync with the movement of the intermediate transfer belt 30 to the secondary transfer nip. At the secondary transfer nip, the multicolor image is transferred from the belt 30 to the incoming sheet S, with a certain small amount of residual toner particles left on the belt surface.

After secondary transfer, the intermediate transfer belt 30 enters the belt cleaner 35, which removes and collects residual toner from the intermediate transfer belt 30. At the same time, the recording sheet S bearing the powder toner image thereon is introduced into the fixing device 27, which fixes the multicolor image in place on the recording sheet S with heat and pressure through the fixing nip N.

Thereafter, the recording sheet S is ejected by the output rollers 13 to the output tray 14 to complete one operational cycle of the image forming apparatus 1.

Figure 3:
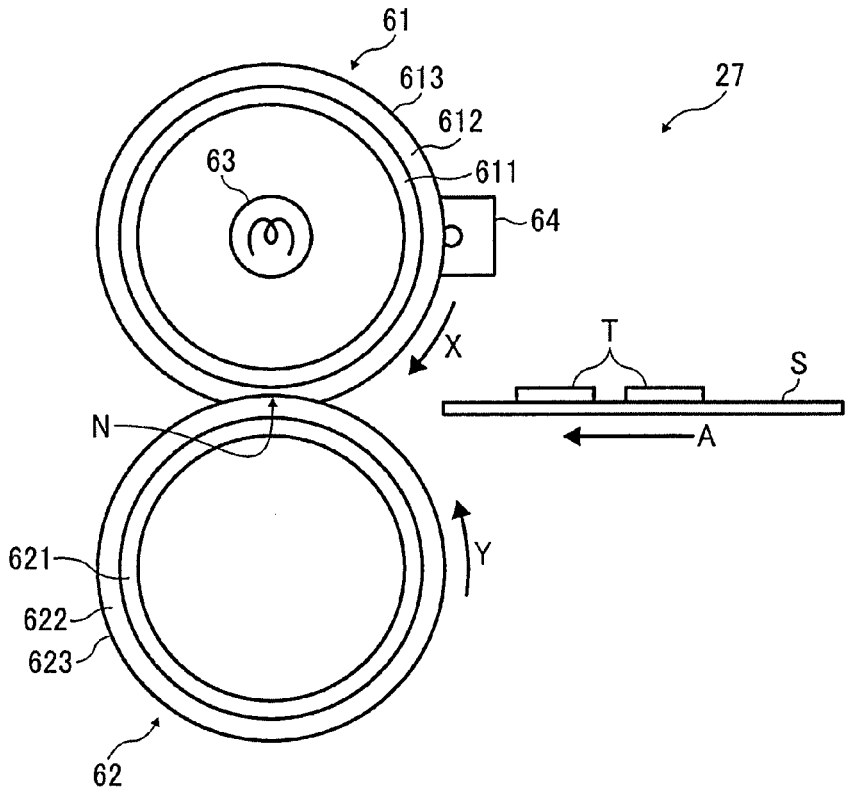
FIG. 3 is an end-on, axial view schematically illustrating one embodiment of the fixing device installed in the image forming apparatus.

FIG. 3 is an end-on, axial view schematically illustrating one embodiment of the fixing device 27 incorporated in the image forming apparatus 1.

As shown in FIG. 3, in the present embodiment of the fixing device 27, the first fixing member comprises a fuser roller 61 extending along a longitudinal axis thereof, and the second fixing member comprises a pressure roller 62 extending along a longitudinal axis thereof. The fuser roller 61 and the pressure roller 62 can rotate around their respective longitudinal axes, while contacting each other with the longitudinal axes generally in parallel to form a fixing nip N therebetween.

The fuser roller 61 is formed of a hollow, cylindrical metal core 611 covered by a layer of elastic material 612 with a coating of release agent 613 applied to an outer surface of the elastic layer 612. The fuser roller 61 has a heat source 63 such as a lamp heater extending along the longitudinal axis to heat the roller body from within, as well as a thermometer 64 to sense temperature of the roller outer surface. The heater 63 and the thermometer 64 are connected to a controller, not shown, which controls the heater 63 according to readings of the thermometer 64 to maintain the temperature of the outer surface at a given processing temperature.

Similarly, the pressure roller 62 is formed of a hollow, cylindrical metal core 621 covered by a layer of elastic material 622 with a coating of release agent 623 applied to an outer surface of the elastic layer 622. The pressure roller 62 has a biasing mechanism, not shown, that presses the pressure roller 62 against the fuser roller 61.

During operation, the fixing device 27 rotates the fuser roller 61 in the direction of arrow X and the pressure roller 62 in the direction of arrow Y to feed a recording sheet S bearing a toner image T thereon in the direction of arrow A. At the same time, the fixing device 27 heats the outer surface of the fuser roller 61 to a temperature sufficient to melt the toner particles. As the sheet S enters the fixing nip N, the toner image T comes into contact with the heated surface of the fuser roller 61. At the fixing nip, the fuser roller 61 melts the toner particles with heat, while the pressure roller 62 promotes settling of the molten toner by pressing the sheet S against the fuser roller 61. The toner image T thus processed under heat and pressure then cools and solidifies and becomes fixed in place as the sheet S leaves the fixing nip N to advance along the sheet feed path A.

Figure 4:
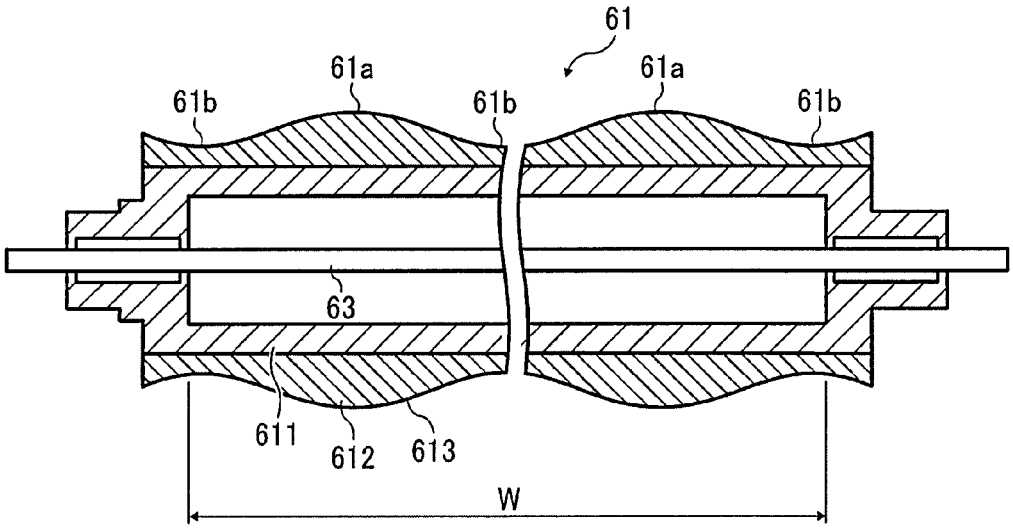
FIG. 4 schematically illustrates a fuser roller used in the fixing device of FIG. 3 along the longitudinal axis in transverse cross-section.

FIG. 4 schematically illustrates the fuser roller 61 along the longitudinal axis in transverse cross-section.

As shown in FIG. 4, the fuser roller 61 has an alternating series of at least one convex portion 61*a* curving outward and at least one concave portion 61*b* curving inward with respect to the longitudinal axis to define an undulating outer peripheral surface 610. The convex and concave portions 61*a* and 61*b* are formed by varying the thickness of the elastic layer 612, with the metal core 611 and the release coating 613 each having a substantially uniform thickness or cross-section along the longitudinal axis. Moreover, in another example that is not depicted, the convex portion of the fuser roller and the concave portion of the fuser roller may be constituted by changing the thickness of the core in the axial direction, or changing the thickness of both the core and the elastic layer in the axial direction.

Each of the convex and concave portions 61*a* and 61*b* has a height with respect to a circumferential plane of the roller 61 in a range of, for example, approximately 0.1 mm to approximately 0.5 mm, and a width along the longitudinal axis of the roller 61 of, for example, approximately 10 mm. The number of convex portions 61*a* and concave portions 61*b* each may be any number equal to or greater than one.

In the present embodiment, the convex portion 61*a* and the concave portion 61*b* are contiguous to each other so that the roller surface 610 as a whole has a continuously undulating configuration, such as a sinusoidal curve or other suitable curve. A series of convex and concave portions 61*a* and 61*b* spans a width W indicating a maximum compatible sheet width of recording medium that the fixing device 27 can accommodate in the fixing nip N. Alternatively, the curving portions 61*a* and 61*b* may be present only over a portion of the maximum compatible sheet width W.

Figure 5:
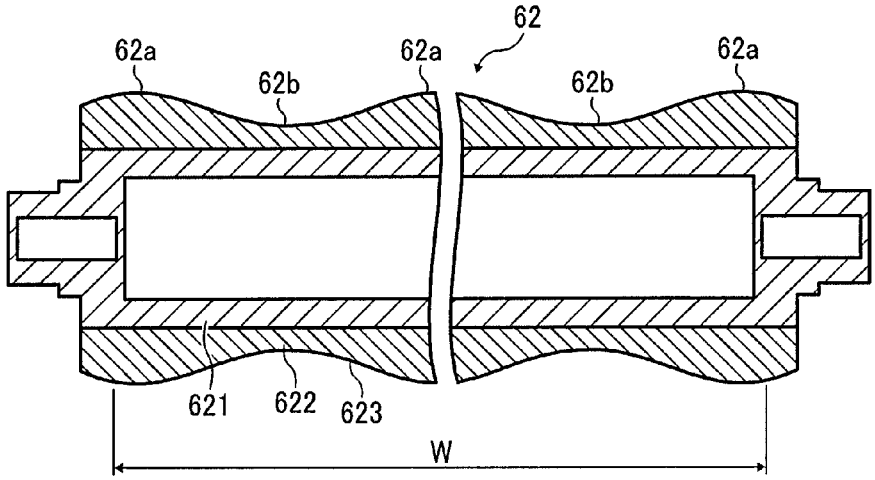
FIG. 5 schematically illustrates a pressure roller used in the fixing device of FIG. 3 along the longitudinal axis in transverse cross-section.

FIG. 5 schematically illustrates the pressure roller 62 along the longitudinal axis in transverse cross-section.

As shown in FIG. 5, the pressure roller 62 has an alternating series of at least one convex portion 62*a* curving outward and at least one concave portion 62*b* curving inward with respect to the longitudinal axis to define an undulating outer peripheral surface 620. The convex and concave portions 62*a* and 62*b* are formed by varying the thickness of the elastic layer 622, with the metal core 621 and the release coating 623 each having a substantially uniform thickness or cross-section along the longitudinal axis. Moreover, in another example that is not depicted, the convex portion of the pressure roller and the concave portion of the pressure roller may be constituted by changing the thickness of the core in the axial direction, or changing the thickness of both the core and the elastic layer in the axial direction.

Each of the convex and concave portions 62*a* and 62*b* has a height with respect to a circumferential plane of the roller 62 in a range of, for example, approximately 0.1 mm to approximately 0.5 mm, and a width along the longitudinal axis of the roller 62 of, for example, approximately 10 mm. The number of convex portions 62*a* and concave portions 62*b* each may be any number equal to or greater than one.

In the present embodiment, as in the case of the fuser roller 61, the convex portion 62*a* and the concave portion 62*b* are contiguous to each other so that the roller surface 620 as a whole has a continuously undulating configuration, such as a sinusoidal curve or other suitable curve, and a series of convex and concave portions 62*a* and 62*b* of the pressure roller 62 may span all or part of the maximum compatible sheet width W.

In the fixing device 27, the fuser roller 61 has the same number of convex portions 61*a* as the number of concave portions 62*b* of the pressure roller 62, and the pressure roller 62 has the same number of convex portions 62*a* as the number of concave portions 61*b* of the fuser roller 61. The convex portions 61*a* of the fuser roller 61 are similar in dimension and position, and preferably, complementary in shape, to the concave portions 62*b* of the pressure roller 62 in the axial direction, and the convex portions 62*a* of the pressure roller 62 are similar in dimension and position, and preferably, complementary in shape, to the concave portions 61*b* of the fuser roller 61 in the axial direction. Such configuration of the fuser and pressure rollers 61 and 62 allows engagement and close contact between their undulating surfaces 610 and 620 by fitting the corresponding convex and concave portions when mounted in the fixing device 27 as described in detail with reference to FIG. 6.

Figure 6:
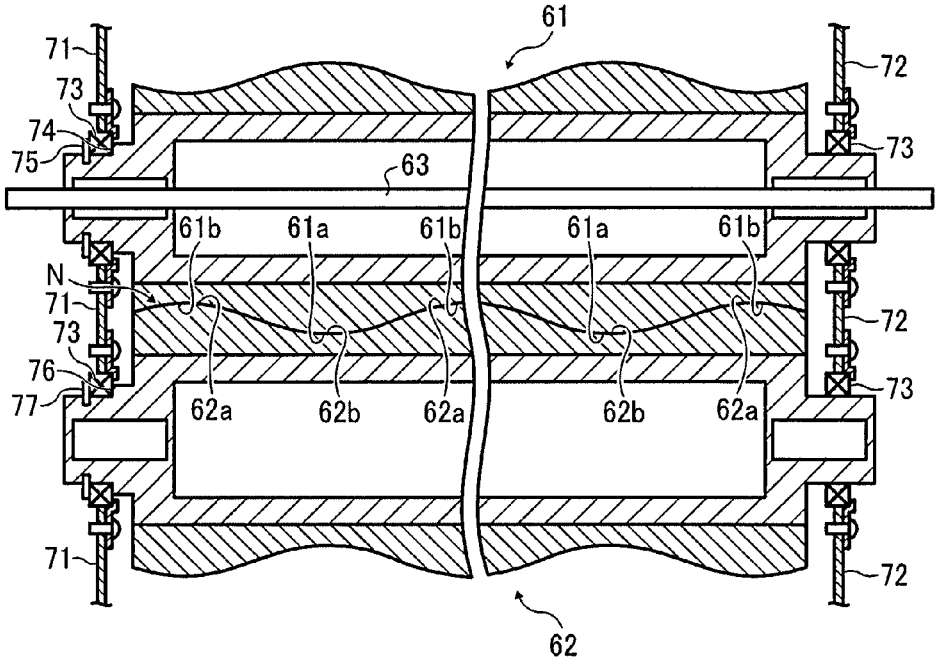
FIG. 6 shows the fuser roller and the pressure roller mounted in the fixing device of FIG. 3.

FIG. 6 shows the fuser roller 61 and the pressure roller 62 mounted in the fixing device 27, with the biasing mechanism of the pressure roller 62 being omitted for clarity.

As shown in FIG. 6, the fixing device 27 accommodates the fuser roller 61 and the pressure roller 62 between a pair of parallel left and right sidewalls 71 and 72 for installation in the image forming apparatus 1. When properly mounted, the rollers 61 and 62 have their cylindrical metal cores 611 and 621 uniformly spaced apart from each other and their undulating surfaces 610 and 620 engaged in pressure contact with each other along the fixing nip N, with each convex portion 61*a* of the fuser roller 61 fitting in the corresponding concave portion 62*b* of the pressure roller 62, and each convex portion 62*a* of the pressure roller 62 fitting in the corresponding concave portion 61*b* of the fuser roller 61.

In such a configuration, the fixing device 27 can temporarily stiffen a recording sheet S during passage through the fixing nip N, so as to reliably feed the sheet S without wrapping the sheet S around the fuser roller 61 even when the sheet S in use is relatively thin and consequently ready to bend and deviate from the proper feed path A.

Specifically, with additional reference to FIG. 3, passing a recording sheet S through the fixing nip N during the fixing process causes the sheet S to conform to the undulating surfaces 610 and 620 of the fuser and pressure rollers 61 and 62. As the sheet S thus becomes undulated and corrugated, it temporarily exhibits an apparent stiffness greater than that exhibited without corrugation. Such temporary stiffening effect allows the recording sheet S to advance past the fixing nip N without wrapping around the fuser roller 61 and causing a jam at the fixing nip N, even when the sheet S in use is relatively thin and ready to bend due to adhesion of molten toner to the surface of the fuser roller 61.

Moreover, the fixing device 27 can maintain a uniform pressure distribution throughout the fixing nip N to provide fixing with uniform gloss across a resulting image.

Specifically, the fuser and pressure rollers 61 and 62 contact each other at substantially uniform pressure along the fixing nip N owing to the engagement between the undulating surfaces 610 and 620 provided by fitting the corresponding convex and concave portions together. Since gloss of an image printed on a recording medium depends on the pressure applied to the recording medium during fixing, the uniform nip pressure exerted on the recording sheet S during passage through the fixing nip N provides uniform gloss across the image T.

Some conventional fixing devices use a precisely cylindrical fixing roller in conjunction with an axially tapered, symmetrical fixing roller that has a diameter greatest at the center and smallest at each end ("crowned"), or conversely, greatest at each end and smallest at the center ("bowed"). In contrast to the undulated fixing rollers 61 and 62, the conventional combination of cylindrical and tapered rollers often results in variation in nip pressure, since they contact each other at higher pressures where the tapered roller diameter is greatest and at lower pressures where the tapered roller diameter is smallest. Such higher and lower pressures present along the fixing nip translate into areas of higher and lower gloss appearing in a resulting image, which is not acceptable for applications in today's high quality image forming apparatuses.

Furthermore, the fixing device 27 can maintain the undulating roller surfaces 610 and 620 in proper engagement with each other, thus ensuring uniform pressure distribution across the fixing nip N after installation of the fixing device 27.

Specifically, with continued reference to FIG. 6, the fuser roller 61 is mounted for rotation around the longitudinal axis with a pair of bearings 73 (e.g., ball bearings) one on each of the sidewalls 71 and 72. The bearing 73 on the left sidewall 71 is secured to the roller 61 by fitting between a flange 74 and a retaining ring 75 provided on the roller end, whereas the bearing 73 on the right sidewall 72 is not secured to the roller 61, thus allowing displacement of the fuser roller 61 with respect to the right sidewall 72 but not to the left sidewall 71 along the longitudinal axis.

Similarly, the pressure roller 62 is mounted for rotation around the longitudinal axis with a pair of bearings 73 (e.g., ball bearings) one on each of the sidewalls 71 and 72. The bearing 73 on the left sidewall 71 is secured to the roller 62 by fitting between a flange 76 and a retaining ring 77 provided on the roller end, whereas the bearing 73 on the right sidewall 72 is not secured to the roller 62, thus allowing displacement of the pressure roller 62 with respect to the right sidewall 72 but not to the left sidewall 71 along the longitudinal axis.

Thus, the fixing rollers 61 and 62 are mounted in the fixing device 27 with one end (in this case the left end) secured to the left sidewall 71 and the other end (in this case the right end) displaceable in the axial direction. Consequently, when the rollers 61 and 62 expand along their respective longitudinal axes by being heated to processing temperature during operation, they elongate solely on the right side while maintaining their left ends aligned with each other. This reduces the risk of misaligning corresponding concave and convex portions of the rollers 61 and 62 after installation of the fixing device 27, which would otherwise detract from uniform nip pressure and from uniform gloss of a resulting image.

For example, consider a case where the fixing device 27 uses the fuser roller 61 and the pressure roller 62 each formed of an aluminum core with a length of 240 mm and a thermal expansion coefficient of $2.42*10^{-6}$ per degree centigrade. The fuser roller 61, when heated from 20° C. to 180° C., extends by approximately 0.933 mm in the axial direction, while the pressure roller 62 extends by a similar amount in the same direction due to the heat conducted from the fuser roller 61. The result is the rollers 61 and 62 displaced relative to each other in the axial direction by an amount of approximately 0.5 mm or less, which is significantly smaller than that experienced by a conventional configuration of fixing rollers.

The side on which the rollers 61 and 62 are fixed or displaceable may be different than that depicted in FIG. 6, as long as the rollers 61 and 62 have one pair of adjacent longitudinal ends positioned in alignment with each other, and the other pair of adjacent longitudinal ends displaceable along the respective longitudinal axes. That is, the fixing rollers 61 and 62 may be mounted with their respective right ends secured to the right sidewall 72 and their respective left ends displaceable in the axial direction, in which case the rollers 61 and 62 can elongate solely on the left side while maintaining their right ends aligned with each other during operation.

Preferably, the convex portion 61*a* of the fuser roller 61 and the concave portion 62*b* of the pressure roller 62 have complementary shapes, and the convex portion 62*a* of the pressure roller 62 and the concave portion 61*b* of the fuser roller 61 have complementary shapes, so that the fuser and pressure rollers 61 and 62 establish close contact with each other with no space between the undulating surfaces 610 and 620 at least over the maximum compatible sheet width W under no-load conditions, i.e., when no force is applied to press the pressure roller 62 against the fuser roller 61.

For example, where one of the undulating surfaces 610 and 620 defines a sinusoidal curve of a given amplitude and frequency, it is desirable that the other one of the surfaces 610 and 620 defines a sinusoidal curve of the same amplitude and frequency to provide uniform close contact therebetween under no-load condition. In this case, when plotted against the position along the longitudinal axes, the thicknesses of the elastic layers 612 and 622 trace a pair of sinusoidal waveforms opposite in phase and identical in amplitude and frequency with respect to each other.

Establishing close contact between the rollers 61 and 62 under no-load conditions ensures good imaging performance of the fixing device 27, since any space left between the roller surfaces 610 and 620 would result in variation in pressure along the fixing nip N under load condition, i.e., when the pressure roller 62 is pressed against the fixing roller 61 upon mounting to the fixing device 27.

Further, preferably, the total thickness of the elastic layers 612 and 622 present between the rollers 61 and 62 is constant at every point along the fixing nip N when the rollers 61 and 62 contact each other under no-load conditions. This also ensures good imaging performance of the fixing device 27, since pressure at a specific point along the fixing nip N is substantially dependent on the amount of elastic material present between the metal cores 611 and 621 which are uniformly spaced from each other, so that variation in the total thickness of the metal layers 612 and 622 under no-load conditions would result in variation in nip pressure under load conditions.

Still further, preferably, the convex and concave portions of the fixing rollers 61 and 62 are contiguous to each other as in the embodiment depicted in FIGS. 4 through 6. This ensures good sheet feeding performance of the fixing device 27, since providing convex and concave portions at intervals would increase the risk of wrinkling a recording sheet corrugated between the undulating surfaces during passage through the fixing nip N.

Figure 7:
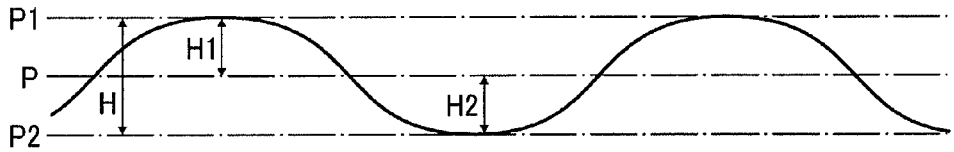
FIG. 7 shows a portion of an undulating surface of the fixing member used in the fixing device.

FIG. 7 shows a portion of the undulating surface of the fixing member used in the fixing device 27, in which an imaginary line "P" represents a reference peripheral plane parallel to the longitudinal axis of the fixing member, "P1" represents an outer peripheral plane defined by apices of the convex portions, and "P2" represents an inner peripheral plane defined by apices of the concave portions.

As shown in FIG. 7, the undulating surface has an amplitude of undulation H defined as a total of H1 and H2, with H1 representing a distance from the outer peripheral plane P1 to the reference plane P (i.e., the height of convex portion), and H2 representing a distance from the inner peripheral plane P2 to the reference plane P (i.e., the height of concave portion). In the present embodiment, the reference plane P is equidistant from the outer and inner planes P1 and P2, so that the curve heights H1 and H2 are equal to half the undulation amplitude H. The values of H1, H2, and H may be established experimentally or theoretically, so as to effect good sheet feeding and image fixing performance of the fixing device 27 according to the specific application.

Preferably, the amplitude H of the undulating surface is in a range of approximately 0.16 mm to approximately 0.8 mm in the fixing nip N. Experiments have shown that an undulation amplitude H smaller than 0.16 mm results in an insufficient amount of curvature of a recording sheet corrugated by passing through the fixing nip N, meaning insufficient sheet stiffening effect of the undulating fixing members, whereas an undulation amplitude H greater than 0.8 mm results in a significant inconsistency in rotational speed at convex and concave portions of the rollers, which can wrinkle a recording sheet passing through the fixing nip N.

As mentioned, the undulating surface of the fixing member is formed by varying the thickness of the elastic layer along the longitudinal axis. Thus, the undulation amplitude H indicates a difference between maximum and minimum thicknesses of the elastic layer along the longitudinal axis. Since the elastic layer is compressed at a certain compression ratio under pressure within the fixing nip N, the undulation amplitude H varies depending on whether the fixing member is under load condition or no-load condition.

For example, the elastic layers 612 and 622 of the fixing rollers 61 and 62 may be compressed to approximately 80% of their original thicknesses (i.e., at a compression ratio of approximately 20% or less) under load conditions, in which case the undulation amplitude H outside the fixing nip N is approximately 1.25 times greater than that within the fixing nip N. Using a compression ratio exceeding 20% is undesirable since it can develop plastic deformation of the material constituting the elastic layer, leading to noises generated during operation, imperfection in resulting images, and other malfunctions of the fixing device 27.

Where the elastic layers 612 and 622 are compressed at a compression ratio of approximately 20%, the amplitude H of the undulating roller surfaces 610 and 620 may be in a range of approximately 0.16 mm to approximately 0.8 mm under load condition, and in a range of approximately 0.2 mm to approximately 1 mm (equivalent to curve heights H1 and H2 ranging from approximately 0.1 mm to approximately 0.5 mm) under no-load conditions.

Figure 8:
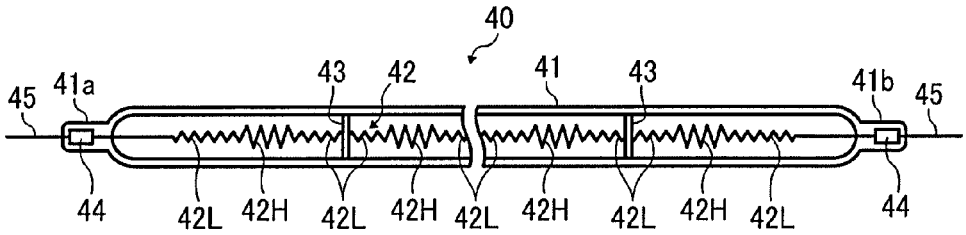
FIG. 8 schematically illustrates a heat lamp.

FIG. 8 is a schematic diagram illustrating a configuration of the heat lamp 40.

Furthermore, the fixing device 27 can reduce differences in temperature between the convex portions 61*a* and the concave portions 61*b* to reduce unevenness in the gross of the fixed image.

Specifically, with reference to FIG. 8, a heat lamp 40 as heat source 61 is inside the fuser roller 61. The heat lamp 40 includes an illuminant tube 41 formed with a light-transmissive material such as quartz. The illuminant tube 41 is filled with an inert gas, and a filament 42 as a heat generating member formed by a tungsten wire coiled partially is provided in the illuminant tube 41. The filament 42 is supported by multiple supporters 43 to prevent contact between the filament 42 and an inner surface of the illuminant tube 41. Sealing portions 41*a* and 41*b* disposed in both end portions of the illuminant tube 41 include a metal foil 44 formed of molybdenum, for example. One end of each metal foil 44 is connected to the filament 42, and the other end of the metal foil 44 is connected to an electrode bar 45 formed of molybdenum, tungsten, or the like. Each electrode bar 45 is electrically connected to an external lead, not shown, and voltage is applied between the two electrodes 45 to energize the filament 42, thereby to generate heat.

The amount of heat generated (heat generation amount) by heat lamp 40 is different in parallel direction to fuser roller 61. Specifically, the heat lamp 40 has plural high heating areas 42H which is larger diameter of the coiled filament 42 than the other area (low heating area 42L). The quantity of the filament 42 to the unit length of the direction of an axis of a fuser roller 61 increases by enlarging the diameter of the coiled filament 42. And the large diameter portions of the coiled filament 42 approach to the inside surface of the fuser roller 61. Therefore it is possible to constitute the high heating area 42H partially on the heat lamp 40. Two or more high heating areas 42H and two or more low heating areas 42L are arranged by turns. Regarding the high heat areas 42H and the low heating areas 42L, the number of turns per unit length (the pitch) and the thickness of the filament 42 are the same over the direction of an axis of a fuser roller 61.

Figure 9:
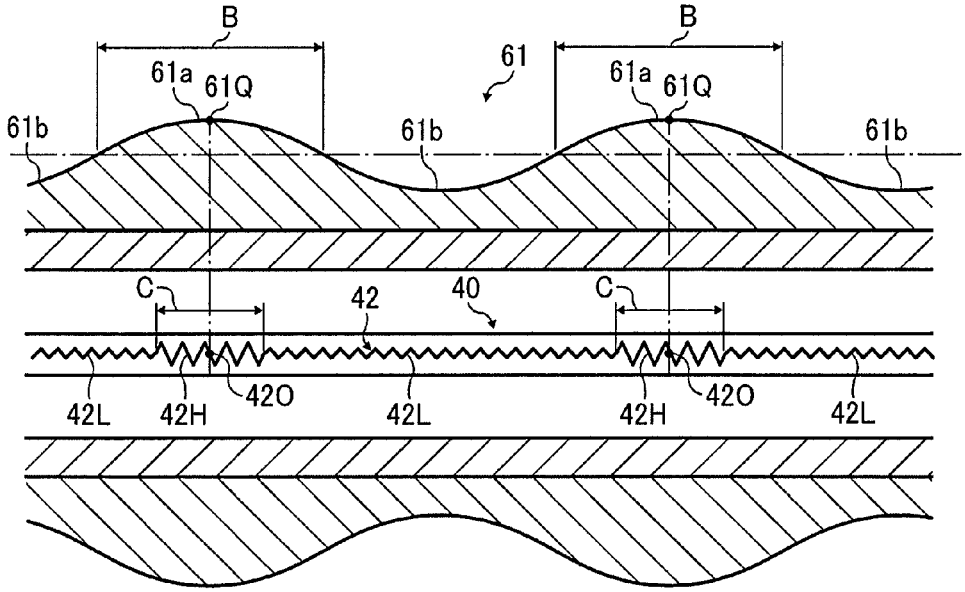
FIG. 9 schematically illustrates a heat lamp inside the fuser roller.

FIG. 9 schematically illustrates a heat lamp inside the fuser roller.

As shown in FIG. 9, the heat lamp 40 is arranged inside the fuser roller 61 so that the high heating area 42H with the large winding diameter of the filament 42 meets the convex portion 61*a* of the fuser roller 61. On the other hand, the concave portion 61*b* does not face the high heating area 42H of the heat lamp 40, but faces the low heating area 42L of the heat lamp 40. The central part 42O of the direction of an axis of the high heating area 42H is arranged in the position corresponding to the top part 61Q of the convex portion 61*a* of fuser roller 61. The range C of the length of the high heating area 42H is 3/10 or more and 1/2 or less of the length B of the convex portion 61*a* with respect to the longitudinal axis. Thus, the heat generation amount in the convex portion 61*a* becomes larger than the heat generation amount in the concave portion 61*b* by arranging the heat lamp 40 inside the fuser roller 61 so that the high heat area 42H corresponds to the convex portion 61*a*.

A configuration of the fixing device 27 according to a second embodiment is described below with reference to FIG. 10.

Figure 10:
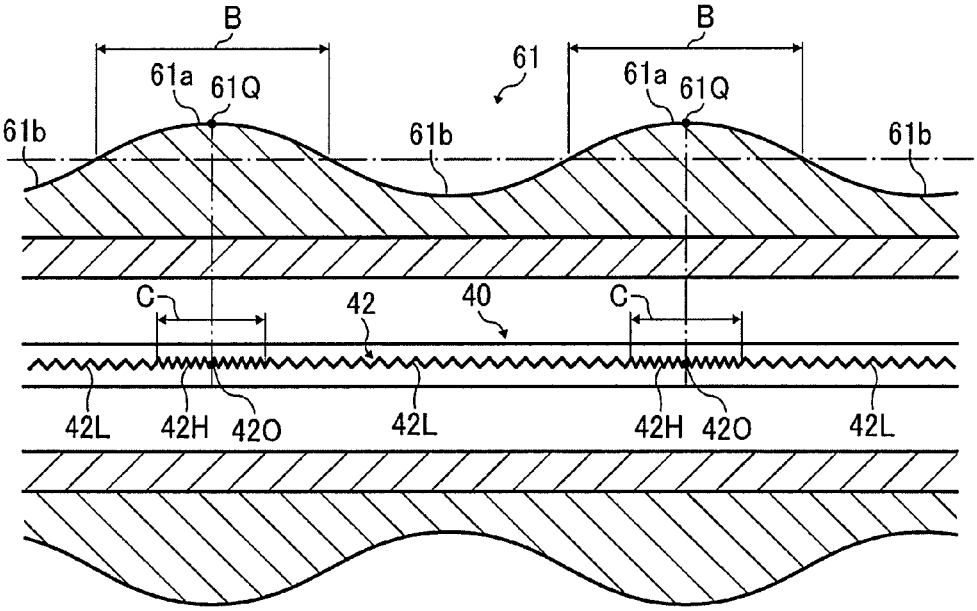
FIG. 10 schematically illustrates a fuser roller mounted in the fixing device of FIG. 3 according to a further example embodiment.

FIG. 10 schematically illustrates the fuser roller mounted in the fixing device of FIG. 3.

The amount of heat generated (heat generation amount) by heat lamp 40 is different in parallel direction to fuser roller 61. The heat lamp 40 has plural high heating areas 42H than the other area (low heating area 42L). Specifically, as shown in FIG. 10, the high heating area 42H is constituted by increasing partially the number of turns per unit length of the filament 42.

The quantity of the filament 42 to the unit length of the direction of an axis of a fuser roller 61 increases by winding many numbers of turns per unit length of the filament 42. Therefore it is possible to constitute the high heating area 42H partially on the heat lamp 40. The heat lamp 40 has two or more high heating areas 42H with many numbers of turns of the filament 42, and two or more low heating areas 42L with few numbers of turns of the filament 42 by turns. Regarding the high heating areas 42H and the low heating areas 42L, the diameter of the winding filament 42 and the thickness of the filament 42 are the same over the direction of an axis of a fuser roller 61.

The heat lamp 40 is arranged inside the fuser roller 61 so that the high heating area 42H with the large winding diameter of the filament 42 meets the convex portion 61*a* of the fuser roller 61. On the other hand, the concave portion 61*b* does not face the high heating area 42H of the heat lamp 40, but faces the low heating area 42L of the heat lamp 40. The central part 42O of the direction of an axis of the high heating area 42H is arranged in the position corresponding to the top part 61Q of the convex portion 61*a* of fuser roller 61. The range C of the length of the high heating area 42H is 3/10 or more and ½ or less of the length B of the convex portion 61*a* with respect to the longitudinal axis. Thus, the heat generation amount in the convex portion 61*a* becomes larger than the heat generation amount in the concave portion 61*b* by arranging the heat lamp 40 inside the fuser roller 61 so that the high heating area 42H corresponds to the convex portion 61*a*. It is possible to constitute the high heating area 42H on the filament 42 also by methods other than the method explained in the case of the embodiment 1 and the case of the embodiment 2 of this invention. For example, the high heating area 42H can be constituted on the heat lamp 40 by making thickness of the filament 42 thick partially.

A configuration of the fixing device 27 according to a third embodiment is described below with reference to FIG. 11.

Figure 11:
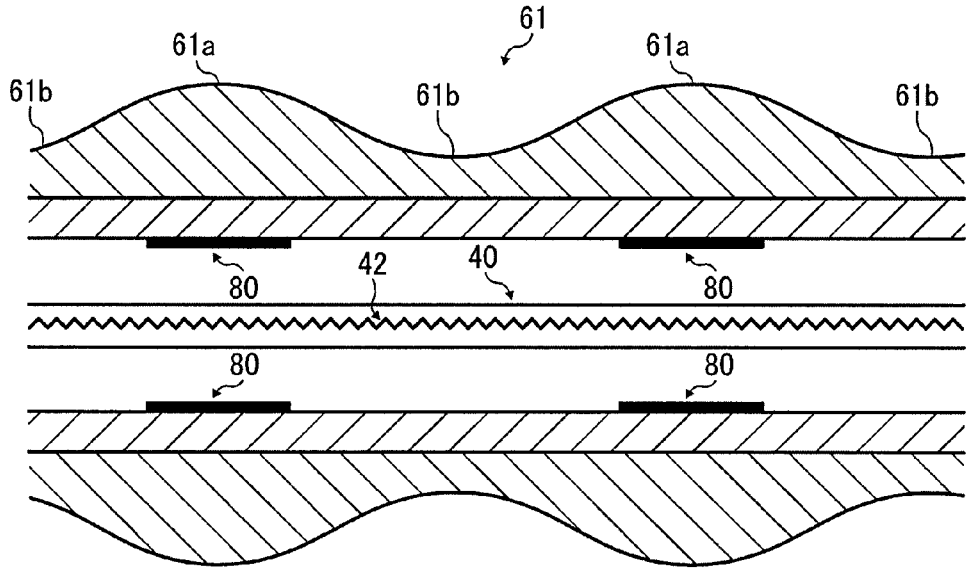
FIG. 11 schematically illustrates a fuser roller mounted in the fixing device of FIG. 3 according to a further example embodiment.

FIG. 11 schematically illustrates the fuser roller mounted in the fixing device of FIG. 3. As shown in FIG. 11, in order to raise a heat absorptivity, a black paint is applied to the inside of the core 611 of the fuser roller 61 with which the convex portion 61*a* is located, and the coat 80 is formed in the fuser roller 61. On the other hand, the coat 80 is not formed in the inner surface of the core 611 of the position corresponding to the concave portion 61*b* of the fuser roller 61. Thus, the heat absorptivity in the inner surface of the convex portion 61*a* becomes higher than the heat absorptivity in the inside of the concave portion 61*b* by forming the coat which raises the heat absorptivity to the inner surface of the position corresponding to the convex portion 61*a*. As the above-mentioned black paint, "Okitsumo (registered trademark in Japan)" of a heat-resistant paint is used. It is also possible to use heat-resistant paints, such as "TETSUZORU (registered trademark in Japan), as the above-mentioned black paint in addition to it. Unlike the embodiments 1 and 2, the heat lamp 40 of this embodiment 3 is constituted so that the heat generation amount of the direction of the axis becomes almost uniform. Unlike the embodiments 1 and 2, regarding this embodiment 3, The diameter of the winding filament 42, the number of turns per unit length of the filament 42 and the thickness of the filament 42 are the same in the direction of the axis respectively.

A configuration of the fixing device 27 according to a fourth embodiment is described below with reference to FIG. 12.

Figure 12:
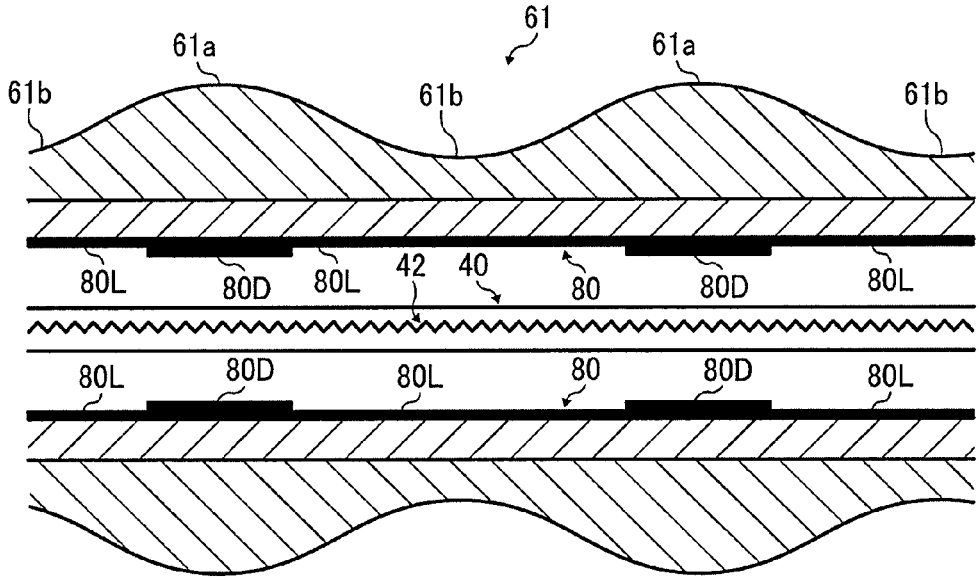
FIG. 12 schematically illustrates a fuser roller mounted in the fixing device of FIG. 3 according to a further example embodiment.

FIG. 12 schematically illustrates the fuser roller mounted in the fixing device of FIG. 3.

As shown in FIG. 12, the coat 80 is formed in the whole inner surface of the core 611 of the fuser roller 61 of this embodiment 4 with the black paints in order to raise the heat absorptivity to the whole inside of the core 611. However the thickness of this coat 80 is different in the axial direction. The coat 80 has the coat thickness part 80D which applied the black paint thickly, and the coat thin part 80L which applied the black paint thinly. The coat thickness part 80D is formed in the inside of the convex portion 61*a* of the fuser roller 61. On the other hand, the coat thickness part 80D is not formed in the inner circumference side of the concave portion 61*b*, but the coat thin part 80L is formed in the inner circumference side of the concave portion 61*b*. Thus, the heat absorptivity in the inner circumference side of the convex portion 61*a* becomes higher than the heat absorptivity in the inner circumference side of the concave portion 61*b*. Regarding this embodiment 4, the heat generation amount of the heat lamp 40 is almost uniform in the axial direction. The paint which improves the heat absorptivity is applied to the inner circumference side of the fuser roller 61 in the case of the embodiments 3 and 4 of this above-mentioned invention. However, it is also possible to use the paint with which the heat absorptivity decreases so that the heat absorptivity of the convex portion 61*a* may differ from the heat absorptivity of the concave portion 61*b*. The heat absorptivity in inner circumference of the convex portion 61*a* becomes high relatively to the heat absorptivity in inner circumference of the concave portion 61*b* by applying the paint with which the heat absorptivity of inner inner circumference of the concave portion 61*b* falls. Moreover, when applying to the whole inner circumference side of the fuser roller 61 the paint that heat absorbency falls, the heat absorptivity of the inner circumference side of the convex portion 61*a* becomes high relatively to the heat absorptivity of the inner circumference side of the concave portion 61*b* by applying the paint to the inner circumference side of the convex portion 61*a* thinly. However, when thermal efficiency is considered, the paint that improve the heat absorptivity is more desirable than the paint that decrease the heat absorptivity.

A configuration of the fixing device 27 according to a Fifth embodiment is described below with reference to FIG. 13.

Figure 13:
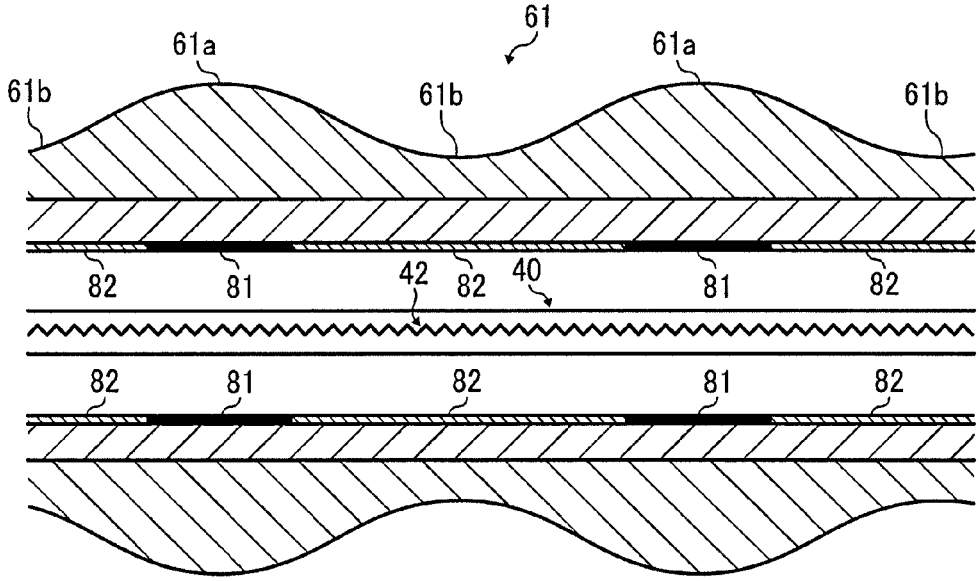
FIG. 13 schematically illustrates a fuser roller mounted in the fixing device of FIG. 3 according to a further example embodiment.

FIG. 13 schematically illustrates a fuser roller mounted in the fixing device of FIG. 3. As shown in FIG. 12, the paint of a different kind in the axial direction is painted on the inner circumference side of the fuser roller 61*a* of this embodiment 5. Two kinds of paints are used in this embodiment 5. These paints differ in a heat absorptivity or the rate of a heat shield mutually. These paints differ in the heat absorptivity or the rate of heat cover mutually. The coat 81 with the high heat absorptivity or the low rate of the heat shield is relatively formed in the inner circumference side of the convex portion 61*a* of the fuser roller 61. On the other hand, the coat 82 with the low heat absorptivity or the high rate of the heat shield is relatively formed in inner circumference side of the concave portion 61*b*. Thus, the heat absorptivity of the inner circumference side of the convex portion 61*a* becomes higher than the heat absorptivity of the inner circumference side of the concave portion 61*b* by forming the coat 81 with the high heat absorptivity or the low rate of the heat shield in the inner circumference side of the convex portion 61*b* relatively. In embodiment 5 of this invention, the heat generation amount of the heat lamp 40 is almost uniform axially.

A configuration of the fixing device 27 according to a Sixth embodiment is described below with reference to FIG. 14.

Figure 14:
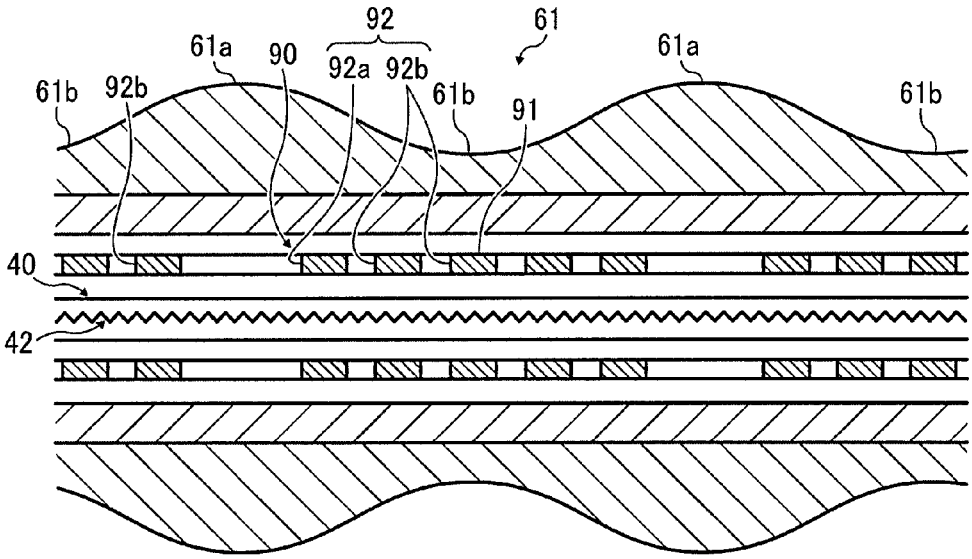
FIG. 14 schematically illustrates a fuser roller mounted in the fixing device of FIG. 3 according to a further example embodiment.

FIG. 14 schematically illustrates the fuser roller mounted in the fixing device of FIG. 3.

As shown in FIG. 14, the fixing device 27 of this embodiment 6 has the heat shield component 90 which covers the part of heat of the heat lamp 40, and this heat shield component 90 is arranged between the fuser roller 61 and the heat lamp 40. This heat shield component 90 is formed by a cylindrical component 91 that has two or more penetration holes 92. The cylindrical component 91 is fixed not to turn. The cylindrical component 91 is made from the material which has heat resistance, for example, metal etc. A part of two or more penetration holes are large holes 92*a*, and these large penetration holes 92*a* are arranged in the position which meets the inner circumference side of the convex portion 61*a* of the fuser roller 61. On the other hand, the small penetration holes 92*b* are arranged in the position which meets the inner circumference side of the concave portion 61*b*. Thus, the quantity (Amount of heat shield) which covers the heat to the convex portion 61*a* becomes smaller than the quantity which covers the heat to concave portion 61*b* by arranging the large penetration hole 92*a* to inner circumference side of the convex portion 61*a*. In embodiment 6 of this invention, the heat generation amount of the heat lamp 40 is almost uniform axially.

Moreover, the heat shield component 90 may be constituted by combining in one the material from which the rate of the heat shield differs.

By arranging so that a portion with a low rate of the heat shield may meet the convex portion 61*a*, the quantity (Amount of heat shield) which covers the heat to the convex portion 61*a* becomes smaller than the quantity which covers the heat to the concave portion 61*b*.

Figure 15:
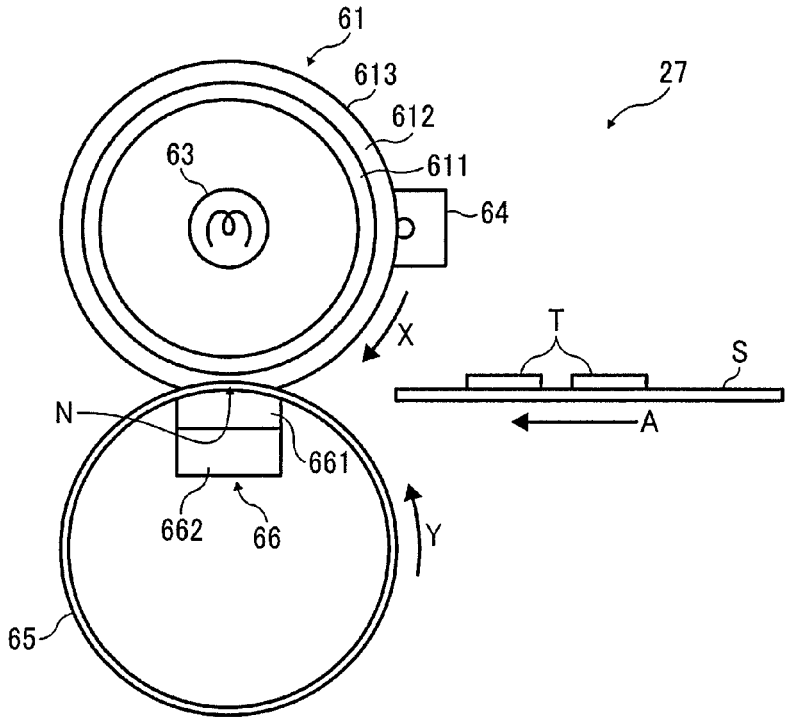
FIG. 15 is an end-on, axial view schematically illustrating a further example embodiment of the fixing device installed in the image forming apparatus.

FIG. 15 is an end-on, axial view schematically illustrating another embodiment of the fixing device 27 incorporated in the image forming apparatus 1.

As shown in FIG. 15, the present embodiment is similar to that depicted in FIG. 3, except that the pressure roller 62 is replaced by a stationary pressure member 66 pressed against the fuser roller 61 through a fixing belt 65. The fuser roller 61 can rotate around the longitudinal axis while contacting the pressure member 66 to define a fixing nip N therebetween, through which the fixing belt 65 rotates around the pressure member 66 upon rotation of the fuser roller 61.

The fuser roller 61 is configured in a manner similar to that depicted above, formed of the hollow, cylindrical metal core 611 covered by the layer of elastic material 612 with the coating of release agent 613 applied to the outer surface of the elastic layer 612, and having the lamp heater 63 and the thermometer 64 to control temperature of the outer surface.

The pressure member 66 is formed of a substantially flat, planar substrate 662 covered by a layer 661 of elastic material such as silicon rubber. The pressure member 66 has a biasing mechanism, not shown, that presses the pressure member 66 against the fuser roller 61 through the fixing belt 65.

The fixing belt 65 comprises an endless smooth belt formed of a suitable flexible material such as a polyimide film and loosely looped around the pressure member 66 without constricting the pressure member 66.

During operation, the fixing device 27 rotates the fuser roller 61 in the direction of arrow X and the fixing belt 65 in the direction of arrow Y to feed a recording sheet S bearing a powder toner image T thereon in the direction of arrow A. At the same time, the fixing device 27 heats the outer surface of the fuser roller 61 to a process temperature sufficient to melt toner particles. As the sheet S enters the fixing nip N, the toner image T comes into contact with the heated surface of the fuser roller 61. At the fixing nip, the fuser roller 61 melts the toner particles with heat, while the pressure member 66 promotes settling of the molten toner by pressing the sheet S between the fixing belt 65 and the fuser roller 61. The toner image T thus processed under heat and pressure then cools and solidifies and becomes fixed in place as the sheet S leaves the fixing nip N to advance along the sheet feed path A.

Figure 16:
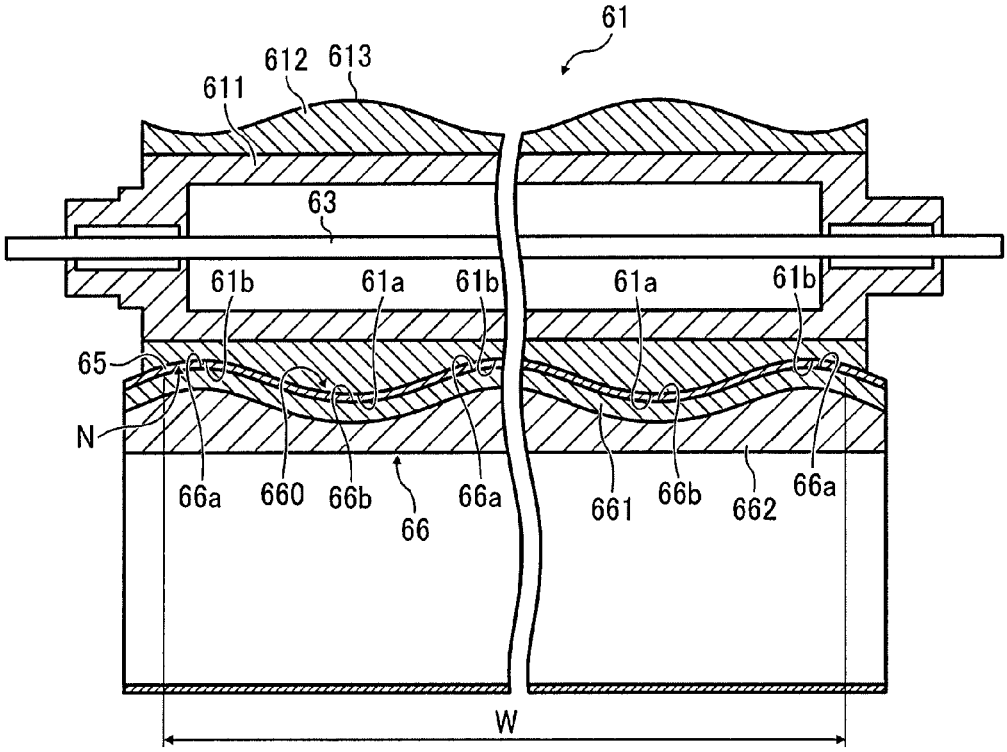
FIG. 16 shows a fuser roller and a pressure member assembled in the fixing device of FIG. 15.

FIG. 16 shows the fuser roller 61 and the pressure member 66 installed in the fixing device 27, with the biasing mechanism of the pressure member 66 omitted for clarity.

As shown in FIG. 16, the configuration of the fuser roller 61 is similar to that depicted in FIG. 6 with its undulating surface 610 having the alternating series of at least one convex portion 61*a* and at least one concave portion 61*b* formed by varying the thickness of the elastic layer 612 along the longitudinal axis. Moreover, in another example that is not depicted, the convex portion of the fuser roller and the concave portion of the fuser roller may be constituted by changing the thickness of the core in the axial direction, or changing the thickness of both the core and the elastic layer in the axial direction.

The pressure member 66 has an alternating series of at least one convex portion 66*a* curving outward and at least one concave portion 66*b* curving inward with respect to the longitudinal axis to define an undulating outer peripheral surface 660. The convex and concave portions 66*a* and 66*b* are formed by varying the thickness of the elastic layer 661, with the substrate 662 having a substantially uniform thickness or cross-section along the longitudinal axis. Moreover, in another example that is not depicted, the convex portion of the pressure member and the concave portion of the pressure member may be constituted by changing the thickness of the substrate in the axial direction, or changing the thickness of both the substrate and the elastic layer in the axial direction.

Each of the convex and concave portions 66*a* and 66*b* has a height with respect to a circumferential plane of the fixing member 66 in a range of, for example, approximately 0.1 mm to approximately 0.5 mm, and a width along the longitudinal axis of the fixing member 66 of, for example, approximately 10 mm. The number of convex portions 66*a* and concave portions 66*b* each may be any number equal to or greater than one.

In the present embodiment, the convex portion 66*a* and the concave portion 66*b* are contiguous to each other so that the outer surface 660 as a whole has a continuously undulating configuration, such as a sinusoidal curve or other suitable curve, similar to those depicted in the embodiments depicted above. As in the case for the fuser roller 61, the series of convex and concave portions 66*a* and 66*b* of the pressure member 66 may span all or part of the maximum compatible sheet width W.

In the fixing device 27, the fuser roller 61 has the same number of convex portions 61*a* as the number of concave portions 66*b* of the pressure member 66, and the pressure member 66 has the same number of convex portions 66*a* as the number of concave portions 61*b* of the fuser roller 61. The convex portions 61*a* of the fuser roller 61 are similar in dimension and position, and preferably, complementary in shape, to the concave portions 66*b* of the pressure member 66 in the axial direction, and the convex portions 66*a* of the pressure member 66 are similar in dimension and position, and preferably, complementary in shape, to the concave portions 61*b* of the fuser roller 61 in the axial direction.

When properly mounted, the fuser roller 61 and the pressure member 66 have the cylindrical metal core 611 and the substrate 662 uniformly spaced apart from each other and their undulating surfaces 610 and 660 engaged in pressure contact with each other through the fixing belt 65 along the fixing nip N, with each convex portion 61*a* of the fuser roller 61 fitting in the corresponding concave portion 66*b* of the pressure member 66, and each convex portion 66*a* of the pressure member 66 fitting in the corresponding concave portion 61*b* of the fuser roller 61. The fixing belt 61 bends and conforms to the undulating surfaces 610 and 660 when sandwiched between the fuser roller 610 and the pressure member 660, and recovers its original smooth shape when released from the fixing nip N.

In such a configuration, the fixing device 27 can temporarily stiffen a recording sheet S during passage through the fixing nip N, so as to reliably feed the sheet S without wrapping around the fuser roller 61 even when the sheet S in use is relatively thin and consequently ready to bend and deviate from the proper feed path A.

Specifically, with additional reference to FIG. 16, passing a recording sheet S through the fixing nip N causes the sheet S to conform to the undulating surfaces 610 and 660 of the fuser roller 61 and the pressure member 66. As the sheet S thus becomes undulated and corrugated, it temporarily exhibits an apparent stiffness greater than that exhibited without corrugation. Such temporary stiffening effect enables the recording sheet S to advance past the fixing nip N without wrapping around the fuser roller 61 and causing a jam at the fixing nip N, even when the sheet S in use is relatively thin and ready to bend due to adhesion of molten toner to the surface of the fuser roller 61.

Moreover, the fixing device 27 can maintain a uniform pressure distribution throughout the fixing nip N to provide fixing with uniform gloss across a resulting image.

Specifically, the fuser roller 61 and the pressure member 66 contact each other at substantially uniform pressure along the fixing nip N owing to the engagement between the undulating surfaces 610 and 660 provided by fitting the corresponding convex and concave portions together. Since gloss of an image printed on a recording medium depends on the pressure applied to the recording medium during fixing process, the uniform nip pressure exerted on the recording sheet S during passage through the fixing nip N provides uniform gloss across the resulting image T.

Although not depicted in FIG. 16, the fixing members 61 and 66 are mounted in the fixing device 27 with a mounting mechanism similar to that depicted in FIG. 6, wherein the fixing members 61 and 66 have one pair of adjacent longitudinal ends positioned in alignment with each other, and the other pair of adjacent longitudinal ends displaceable along the respective longitudinal axes.

Thus, when the fixing members 61 and 66 expand along their respective longitudinal axes by being heated to the processing temperature during operation, they elongate solely on one side while maintaining their ends on the other side aligned with each other. This reduces the risk of misaligning corresponding concave and convex portions of the fixing members 61 and 66 after installation of the fixing device 27, which would otherwise detract from uniform nip pressure and from uniform gloss of a resulting image processed by the fixing device.

Preferably, the convex portion 61*a* of the fuser roller 61 and the concave portion 66*b* of the pressure member 66 have complementary shapes, and the convex portion 66*a* of the pressure member 66 and the concave portion 61*b* of the fuser roller 61 have complementary shapes, so that the fuser and pressure members 61 and 66 establish close contact with each other with no space between the undulating surfaces 610 and 660 at least over the maximum compatible sheet width W under no-load conditions.

For example, where one of the undulating surfaces 610 and 660 defines a sinusoidal curve of a given amplitude and frequency, it is desirable that the other one of the surfaces 610 and 660 defines a sinusoidal curve of the same amplitude and frequency to provide uniform close contact therebetween under no-load condition. In this case, when plotted against the position along the longitudinal axes, the thicknesses of the elastic layers 612 and 662 trace a pair of sinusoidal waveforms opposite in phase and identical in amplitude and frequency with respect to each other.

Further, preferably, the total thickness of the elastic layers 612 and 661 present between the fixing members 61 and 66 is constant at every point along the fixing nip N when they contact each other under no-load conditions.

Still further, preferably, the convex and concave portions of the undulating fixing members 61 and 66 are contiguous to each other as in the present embodiment depicted in FIG. 16.

Still further, preferably, the amplitude H of the undulating surfaces 610 and 660 is in a range of approximately 0.16 mm to approximately 0.8 mm under load condition. Where the elastic layers 612 and 622 is compressed at a compression ratio of approximately 20%, the amplitude H of the undulating surfaces 610 and 660 may be in a range of approximately 0.16 mm to approximately 0.8 mm under load condition, and in a range of approximately 0.2 mm to approximately 1 mm under no-load conditions.

Moreover, the heat source 63 of this embodiment 7 is the same heat lamp as the embodiments 1 through 6. The heat generation amount of the heat lamp 63 differs in the axial direction so that the heat generation amount of the inner circumference side of the convex portion 61*a* may become higher than the heat generation amount of the inner circumference side of the concave portion 61*b*. Moreover, the coat may be formed in the inner circumference side of the fuser roller 61 of this embodiment 7 so that the heat absorptivity of the inner circumference side of the convex portion 61*a* may become higher than the heat absorptivity of the inner circumference side of the concave portion 61*b*. Moreover, the same heat shield component 90 as the case of the embodiment 6 may be arranged at the fuser roller 61 of this case of the embodiment 7 so that the amount of heat shield of the convex portion 61*a* may become smaller than the amount of heat shield of the concave portion 61*b*.

Experiments described below were conducted to evaluate the efficacy of the fixing device 27 in terms of sheet feeding performance, uniformity in nip pressure and uniformity in temperature of the fuser roller, and specifically, those of the undulating fixing members in comparison with conventional configurations of fixing members.

Experiment 1

Sheet stiffening effect of the undulating fixing roller was evaluated using fixing devices T1 through T3: test device T1 incorporating a pair of undulating rollers each having three convex and three concave portions to form undulations with an amplitude of approximately 0.2 mm under no-load condition; test device T2 incorporating a pair of undulating rollers each having seven convex and seven concave portions to form undulations with an amplitude of approximately 0.2 mm under no-load condition; and test device T3 having a pair of simple cylindrical rollers each with no undulation on the outer surface for comparison purposes. In the fixing devices T1 through T3, the thickness of the elastic layer of the fuser roller and the thickness of the elastic layer of the pressure roller are set as 1.7 mm, respectively.

Figure 17:
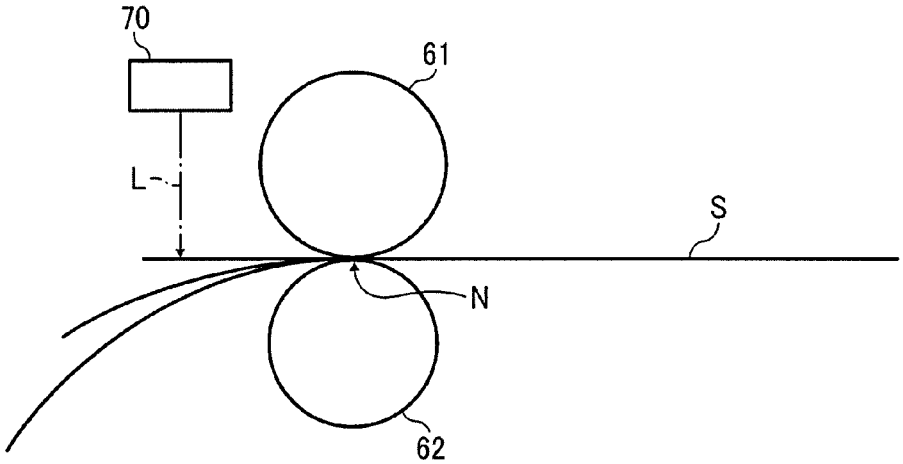
FIG. 17 shows test equipment used in experiments for evaluating sheet stiffening effect of the fixing device.

Apparent stiffness exhibited by paper sheets during passage through the fixing nip was measured with equipment as shown in FIG. 17. As shown, the measurement equipment includes a laser displacement sensor 70 that directs a laser beam L toward a measurement point downstream of a fixing nip N defined between a fuser roller FR and a pressure rollers PR to obtain an amount by which a paper sheet S displaces from a reference plane representing the proper sheet feed path as it passes the measurement point.

In measurement, the paper sheet S was fed into the fixing nip N along the sheet feed path. As the leading edge of the sheet S reached the measurement point, the rollers FR and PR stopped rotation to hold the sheet S at the fixing nip N, and the displacement sensor 70 measured the displacement of the sheet S from the proper sheet feed path. Then, the rollers FR and PR resumed rotation to advance the sheet S by a given distance, and the displacement sensor 70 again measured the displacement of the sheet S from the proper sheet feed path.

After measurement, apparent stiffness of the paper sheet S during passage through the fixing nip N was determined based on an amount by which the sheet S was bent away from the sheet feed path, calculated as a difference between the displacements of the sheet S measured as it reaches and advances past the measurement point downstream the fixing nip N. The experiments were conducted on each test device using three types of paper sheets: thin paper S1 weighing 64 grams per square meter ($g/m^2$), thick paper S2 weighing 69 $g/m^2$, and very thick paper S3 weighing 90 $g/m^2$.

Figure 18:
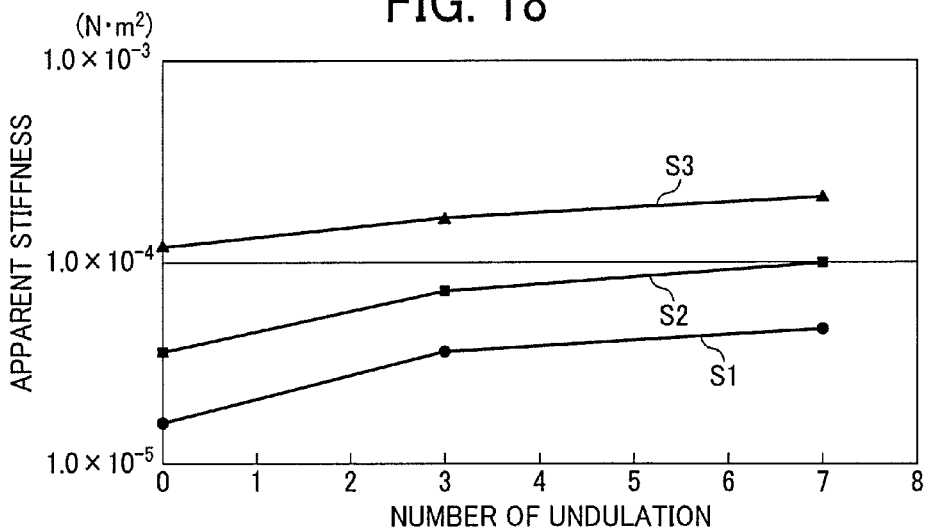
FIG. 18 is a graph plotting measurements of apparent stiffness of paper sheets obtained through the experiments.

FIG. 18 is a graph plotting measurements of apparent stiffness of the paper sheets S1 through S3 in $N*m^2$ against number of undulations per roller of the fixing device. In this graph, the undulation number of 3 indicates measurements obtained using the test device T1, of 7 indicates those obtained using the test device T2, and of 0 indicates those obtained using the comparative example T3.

As shown in FIG. 18, all the three types of paper sheets S1 through S3 exhibited greater values of apparent stiffness with the test devices T1 and T2 than with the device T3. Moreover, the apparent stiffness of each type of paper S obtained with the device T2 with seven undulations is greater than that obtained with the device T1 with three undulations.

The experimental results show that passing a paper recording sheet through a nip defined between a pair of undulating rollers increases the apparent stiffness of the sheet compared to that exhibited by the sheet passed through a nip defined between a pair of perfectly cylindrical rollers, which demonstrates the sheet stiffening effect provided by the fixing device 27. Also, comparison of the test devices T1 and T2 with different numbers of roller undulations indicates that the stiffening effect of the undulating roller increases with the number of undulations.

Experiment 2

Sheet stiffening effect of an undulating roller pair was evaluated using fixing devices T4 and T5: test device T4 with a pair of rollers each having only a single convex or concave portion forming a simple outward or inward curve on the roller surface; and test device T5 with a pair of rollers each having a single convex portion and a single concave portion together forming one undulation on the roller surface.

In Experiment 2, apparent stiffness of a recording sheet during passage through the fixing nip N was measured using multiple sets of test devices with varying amplitudes of curve or undulation for each of the fixing devices T4 and T5.

Figure 19A:
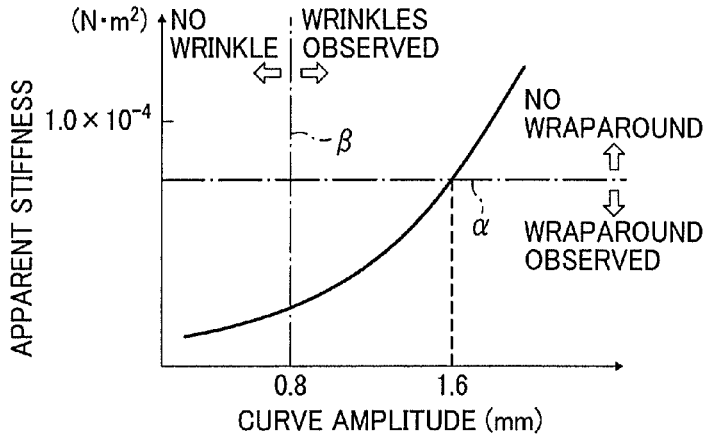
FIGS. 19A and 19B are graphs plotting measurements of apparent sheet stiffness against amplitude of curve or undulation of test devices obtained through the experiments.
Figure 19B:
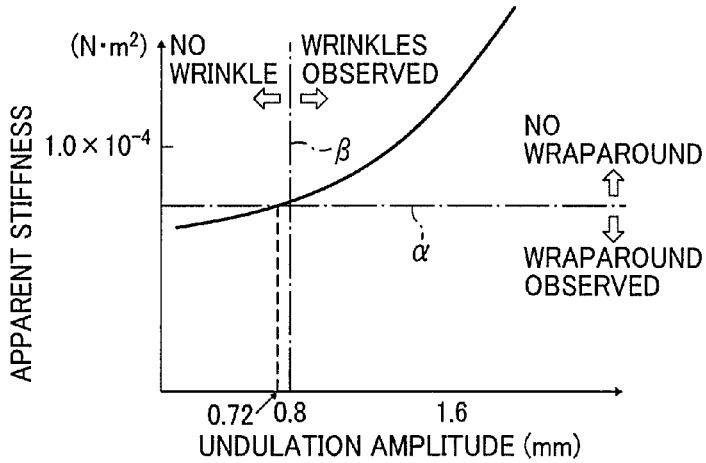

FIGS. 19A and 19B are graphs plotting measurements of apparent sheet stiffness in $N*m^2$ against the amplitude of curve or undulation in mm of the test devices T4 and T5, respectively, obtained through Experiment 2. In the graphs, a line $\alpha$ represents a minimum allowable sheet stiffness with which the fixing device can feed a recording sheet through the fixing nip without wrapping around the fuser roller, and a line $\beta$ represents a maximum allowable amplitude of curve or undulation with which the fixing device can forward a recording sheet without causing wrinkles on the sheet.

As shown in FIGS. 19A and 19B, an increase in apparent sheet stiffness was effected by increasing the amount of curve or undulation amplitude in each of the test devices T4 and T5, and the sheet stiffening effect at a given curve/undulation amplitude observed in the device T5 was significantly greater than that observed in the device T4.

Specifically, as shown in FIG. 19A, the apparent stiffness of the recording sheet obtained using the device T4 reaches the minimum allowable stiffness $\alpha$ at a curve amplitude of approximately 1.6 mm which is beyond the maximum allowable amplitude $\beta$ of 0.8 mm. This means that the recording sheet can pass through the fixing nip N without wraparound but with wrinkles when the curve amplitude is over 1.6 mm, and without wrinkles but with wraparound when the curve amplitude is below 0.8 mm.

On the other hand, as shown in FIG. 14B, the apparent stiffness of the recording sheet obtained using the device T5 reaches the minimum allowable stiffness $\alpha$ at an undulation amplitude of approximately 0.72 mm which is below the maximum allowable amplitude $\beta$ of 0.8 mm. This means that the recording sheet can pass through the fixing nip N without wrinkles and/or wraparound where the amplitude of undulation is in the range of 0.72 mm to 0.8 mm.

The experimental results show that the pair of undulating rollers is superior to the pair of simply curved rollers in terms of sheet stiffening effect obtained with a given value of curve/undulation amplitude, in which feeding the recording sheet without wraparound and wrinkles is possible with the pair of undulating rollers with adequate undulation amplitude, but not with the pair of simply curved rollers. This demonstrates the superiority of the fixing device having a pair of undulating rollers each with at least one undulation, of which the sheet stiffening effect may be further enhanced by increasing the number of undulations as indicated by the results of Experiment 1.

Experiment 3-1

It is also important to equalize the temperature in addition to the contact pressure in the fixing nip for the reliable image formation with uniform gross. However, in the above-described embodiments, the thickness of the fixing roller 61 is different in the axial direction because of the convex portions 61*a* and the concave portions 61*b*, which can cause the surface temperature of the fuser roller 61 to fluctuate in the axial direction.

Figure 20:
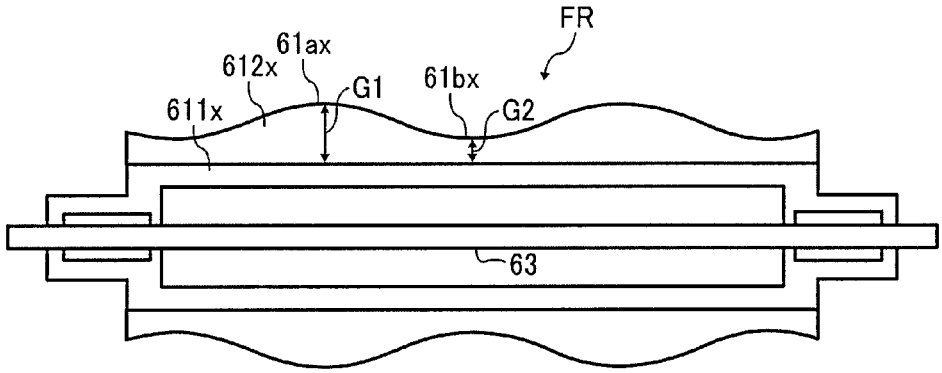
FIG. 20 is simply a schematic diagram illustrating a fuser roller.
Figure 21:
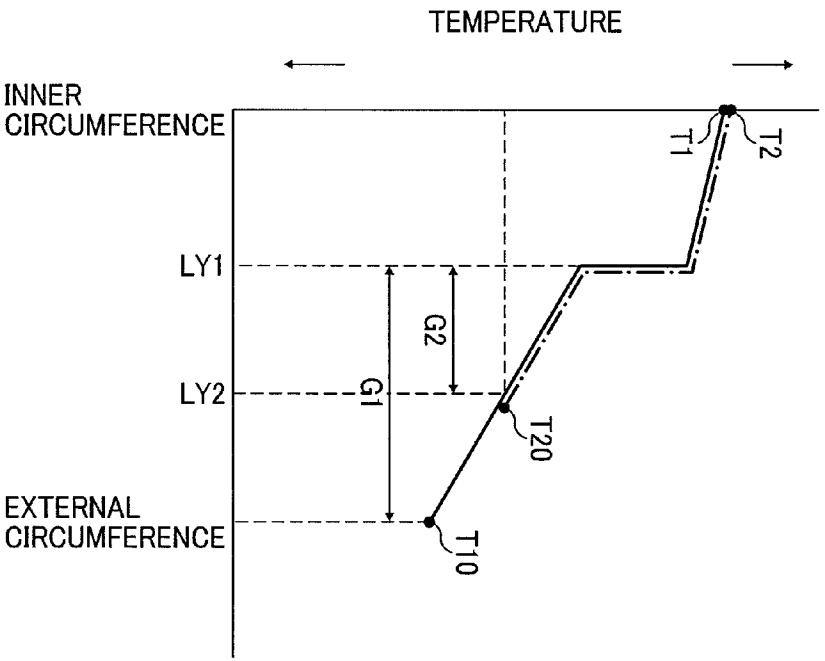
FIG. 21 is a graph illustrating differences in the surface temperature between the crown portion (convex portion) and the inverted-crown portion (concave portion)

FIG. 20 illustrates a comparative example 1 in which the fuser roller FR has a metal core 611X whose thickness is uniform and an elastic layer 612X whose thickness is uneven, that is, convex portions 61*a*X and concave portions 61*b*X are formed in the elastic layer 612X, and a single heat lamp 63 is used to heat the fixing roller FR. FIG. 21 illustrates changes in temperature at a thickest position having a maximum thickness G1 in the convex portion 61*a*X and a thinnest position having a minimum thickness G2 in the concave portion 61*b*X when the heat lamp 60 uniformly heats an inner circumferential surface of the fuser roller FR. In FIG. 21, a vertical axis represents temperature, and a horizontal axis represents the distance from the inner circumference to the external circumference in the fuser roller FR. Reference characters LY1 represents the border between the metal core 611X and the elastic layer 612X and LY2 represents an external surface of the inverted-crown portion 61*b*X, a solid line represents the temperature of the crown portion 61*a*X, and alternate long and short lines represent the temperature of the inverted-crown portion 61*b*X.

When the inner circumferential surface of the fuser roller FR is heated uniformly, a temperature T1 on an inner surface of the convex portion 61*a*X is substantially similar to a temperature T2 on an inner surface of the concave portion 61*b*X as shown in FIG. 21. However, because the elastic layer 612X is thicker in the convex portion 61*a*X than in the concave portion 61*b*X (G1>G2), temperature decreases greater in the convex portion 61*a*X while the heat is transmitted to the external circumference. Consequently, a temperature T10 on the external surface of the convex portion 61*a*X is lower than a temperature T20 on the external surface of the concave portion 61*b*X.

If the surface temperature is thus different between the convex portions 61*a*X and the concave portions 61*b*X, the gross of the fixed image is uneven, degrading image quality. It is to be noted that, although fluctuates in the surface temperature of the fuser roller FR are also caused when the thickness of the metal core 611X (shown in FIG. 20) is not uniform, fluctuations in the surface temperature of the fuser roller FR tend to be greater when the thickness of the elastic layer 612X (shown in FIG. 20) is not uniform.

Figure 22:
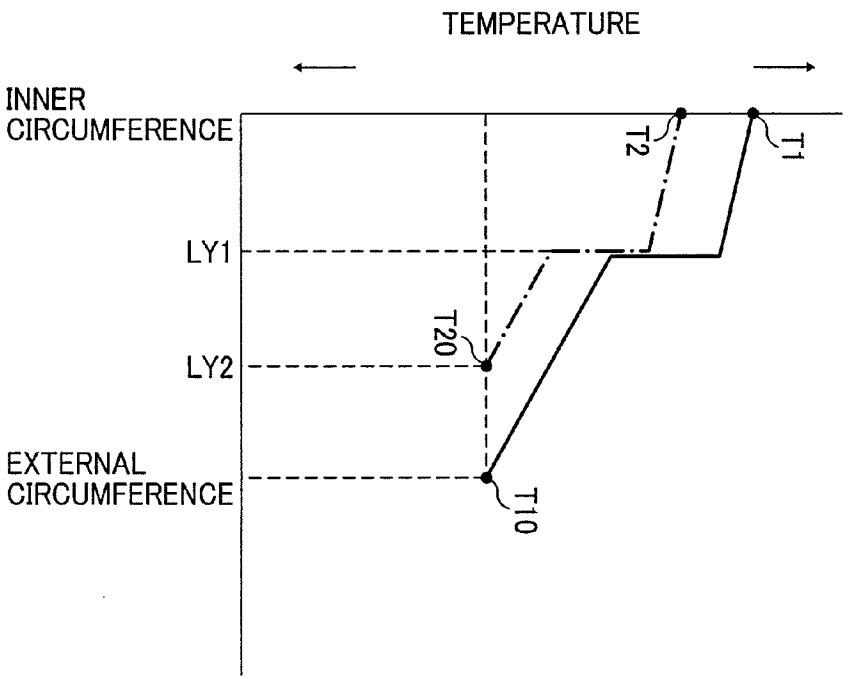

Therefore, in the first and second embodiments, as shown in FIGS. 9 and 10, by arranging the high heating areas 42H of the heat lamp 40 in the position which meets the convex portion 61*a*, the heat generation amount of the convex portion 61*a* becomes larger than the heat generation amount of the concave portion 61*b*. Thereby, as shown in FIG. 22, the temperature T1 of the inner circumference side of the convex portion 61*a* becomes larger than the temperature T2 of the concave portion 61*b*. And since the difference of the temperature T10 and T20 transmitted to each external surface of the convex portion 61*a* and the concave portion 61*b* can be reduced, the temperature of the fuser roller 61 becomes uniform.

Moreover, as for the case of the embodiments 3 through 5 of this invention, as shown in FIGS. 11 through 13, the heat absorptivity of inner circumference of the convex portion 61*a* becomes higher than the heat absorptivity of inner circumference of the concave portion 61*b* by painting inner circumference of the fuser roller 61. Also in this case, the temperature T1 of the inner circumference side of the convex portion 61*a* becomes larger than the temperature T2 of the concave portion 61*b* like the embodiments 1 and 2. And the difference of each temperature T10 and T20 on the external surfaces of the convex portion 61*a* and the concave portion 61*b* can be decreased.

Moreover, as for the case of the embodiment 6 of this invention, as shown in FIG. 14, the amount of heat shield of the convex portion 61*a* becomes smaller than the amount of heat shield of the concave portion 61*b* by arranging the heat shield component 90 between the fuser roller 60 and the heat lamp 40. Since the temperature T1 of the inner circumference side of the convex portion 61*a* becomes larger than the temperature T2 of the concave portion 61*b* like the embodiments 1 through 5, the difference of each temperature T10 and T20 on the external surfaces of the convex portion 61*a* and the concave portion 61*b* can be decreased.

In addition, since the temperature of the convex portion 61*a* of the inner circumference side of the fuser roller 61 becomes higher than the temperature of the concave portion 61*b* of the inner circumference side of the fuser roller 61, the fixing device 27 of this embodiment 7 can decrease the difference of the temperature on the external surfaces in the convex portion 61*a* and concave portion 61*b* of the fuser roller as well as the case of the embodiments 1 through 6 of this invention.

Experiment 3-2

By the way, the radiant heat emitted from the filament 42 of the heat lamp 40 is transmitted not only in the direction of a path of a fuser roller 61 but in the direction of an axis. In the case of the embodiments 1 and 2, as shown in FIGS. 8 and 9, since the range heated at a high temperature will become large in the axial direction too much if the high heating area 42H of the filament 42 is arranged to the whole axial direction length B of the convex portion 61*a*, it is also considered that the difference of the temperature on external surface of the fuser roller 61 cannot be decreased effectively. Then, this inventor performed the examination which investigates the relation between the arrangement range C of the high heating area 42H to axial direction length B of the convex portion, and the difference of the temperature on external surface of the fuser roller 61. Hereafter, this examination is explained in detail.

The inventor used the fixing device of the embodiment 1 as test fixing devices T6 through T8 for an examination. The amount of luminescence of a high heating area of a heat lamp of the test device T6 is 150% to the amount (100%) of luminescence of a low heating area. The amount of luminescence of a high heating area of a heat lamp of the test device T7 is 200% to the amount (100%) of luminescence of a low heating area. The amount of luminescence of the high heating area of a heat lamp of the test device T8 is 300% to the amount (100%) of luminescence of a low heating area.

And in each test device T6 through T8, the inventor printed by changing ratio of a high heating area (the axial direction length of the high heating area of a heat lamp to the axial direction length of the convex portion of a fuser roller) in 0 to 100% of range. And the degree of gloss of each resulting image was measured. In addition, in the degree evaluation examination of gloss, the inventor used the gloss meter PG-1M (product name) by NIPPON DENSHOKU INDUSTRIES CO., LTD and measured the degree of gloss with the 60-degree specular gloss measuring method of the gloss standards of JISZ8741.

Figure 23:
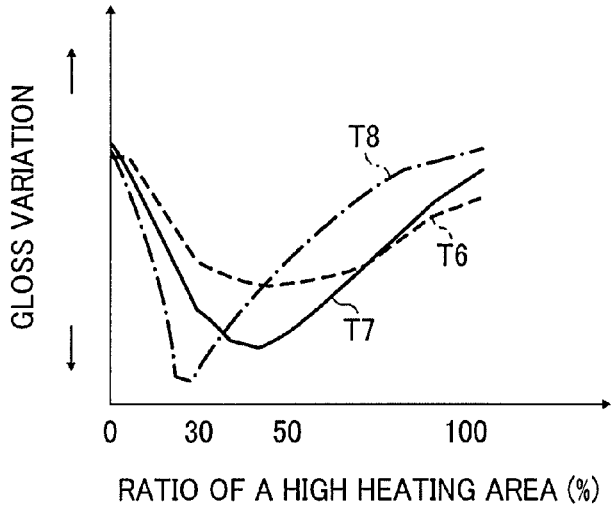
FIG. 23 is a graph showing a relation between image gloss variation and ratio of high heating area obtained through the experiments.

FIG. 23 is a graph showing a relation between image gloss variation and ratio of high heating area obtained through the experiments. In FIG. 23, a horizontal axis represents the ratio of a high heating area, and the vertical axis represents the variation of the degree of gloss (gloss variation). Moreover, in FIG. 23, a dotted line indicates measured value in case the amount of luminescence of the high heating area to a low heating area is 150%. A solid line indicates measured value in case the amount of luminescence of a high heating area is 200%. One-point chain line indicates measured value in case the amount of luminescence of a high heating area is 300%. The graph shown in FIG. 23 shows that the variation of the degree of gloss becomes large as the ratio of the high heating area approaches to 0%. If the ratio of a high heating area approaches to 0%, the amount of luminescence of the heat lamp will become uniform in the axial direction. For this reason, Difference arises in the temperature of external surface of the thick convex portion and the thin concave portion. Moreover, on the contrary, also when the ratio of the high heating area approaches to 100%, the variation of the degree of gloss becomes large. If the ratio of the high heating area approaches to 100%, the range heated by the high heating area will become large in the axial direction of the fuser roller too much. For this reason, Difference in the temperature of external surface of the fuser roller was not able to be controlled effectively.

On the other hand, FIG. 23 shows that the variation of the degree of gloss becomes small, when the ratio of the high heating area is set as 30 to 50% of range. By setting the ratio of the high heating area as 30 to 50% of range, superfluous heating by the high heating area is suppressed. And it is shown that FIG. 23 can control effectively the difference in the temperature of external surface of the convex portion and the concave portion.

In the cases of the embodiments 1 and 2 of this invention, as explained in FIGS. 8 and 9, the central part O of the axial direction of the high heating area 42H is arranged so that it may correspond to the top part Q of the convex portion 61*a*. Moreover, the arrangement range C of the high heating area 42H is set as 30% or more 50% or less of range of axial direction length B of the convex portion 61*b*.

Thereby, the range heated by the high heating area 42H can stop becoming large too much in the axial direction. And the difference in the temperature of the surface of the fuser roller can be controlled effectively.

Numerous additional modifications and variations are possible in light of the above teachings. For example, although the fixing device 27 is described as being incorporated in the multicolor printer 1 as shown in FIG. 2, the fixing device is applicable to various types of electrophotographic image forming apparatus, such as monochrome printers, photocopiers, facsimiles, or multifunctional machines incorporating several of these imaging functions. It is therefore to be understood that, within the scope of the appended claims, the disclosure of this patent specification may be practiced otherwise than as specifically described herein.

What is claimed is:

1. A fixing device that fixes a toner image in place on a recording medium, the fixing device comprising:

a cylindrical first member extending along a first longitudinal axis, a thickness of an external circumferential surface of the first member varying along the first longitudinal axis to define at least one first convex portion curving outward and at least one first concave portion curving inward with respect to the first longitudinal axis, a thickness of the first convex portion being larger than a thickness of the first concave portion;

a second member extending along a second longitudinal axis parallel to the first longitudinal axis, a thickness of an external circumferential surface of the second member varying along the second longitudinal axis to define at least one second convex portion curving outward and at least one second concave portion curving inward with respect to the second longitudinal axis, at least one of the first and second members being pressed against the other of the first and second members, with the first convex portion engaging the second concave portion and the first concave portion engaging the second convex portion, to define a fixing nip therebetween through which the recording medium is passed to fix the toner image under heat and pressure; and a heating source disposed in the first member to heat the first member, wherein, when the heating source heats the first member, a temperature of an inner circumference side of the first convex portion is higher than a temperature of an inner circumference side of the first concave portion, wherein an inner surface of the first member is coated in a paint so that a heat absorptivity of an inner surface of the first convex portion is higher than a heat absorptivity in an inner surface of the first concave portion.

2. The fixing device according to claim 1, wherein the first member comprises an internally heated fuser roller rotatable around the first longitudinal axis, and the second member comprises a pressure roller pressed against the fuser roller for rotation around the second longitudinal axis.

3. The fixing device according to claim 2, wherein the first member and the second member are mounted in the fixing device with a first end secured so as to be fixed with respect to an axial direction of the first and second members, and a second end displaceable in the axial direction of the first and second members.

4. The fixing device according to claim 1, wherein the first member comprises an internally heated fuser roller rotatable around the first longitudinal axis, and the second member comprises a stationary pressure member pressed against the fuser roller through an endless, fixing belt looped for rotation around the pressure member.

5. The fixing device according to claim 1, wherein corresponding engaged convex and concave portions of the first and second members contact each other with no space therebetween.

6. The fixing device according to claim 1, wherein the first convex portion and the first concave portions are contiguous along the first longitudinal axis, and the second convex portion and the second concave portion are contiguous along the second longitudinal axis.

7. The fixing device according to claim 1, wherein the cylindrical first member comprises a first elastic layer, wherein the second member comprises a second elastic layer, wherein a total of thicknesses of the first and second elastic layers between the first and second members is substantially constant at every point along the longitudinal axes.

8. The fixing device according to claim 1, wherein the heating source includes a first heating portion and a second heating portion, the first heating portion is disposed at a position corresponding to the first convex portion in the first longitudinal axis, the second heating portion is disposed at a position corresponding to the first concave portion in the longitudinal axis, and a heat generation amount of the first heating portion is larger than a heat generation amount of the second heating portion.

9. The fixing device according to claim 8, wherein the heating source includes a filament, and the filament has a larger winding diameter in the first heating portion than the second heating portion.

10. The fixing device according to claim 8, wherein the heating source includes a filament, the filament has a larger number of turns per unit length in the first heating portion than the second heating portion.

11. The fixing device according to claim 8, wherein a central part of the first heating portion is arranged in a position corresponding to a top part of the first convex portion, and a range of a length of the first portion is 3/10 or more and ½ or less of a length of the first convex portion with respect to the first longitudinal axis.

12. The fixing device according to claim 1, wherein an inner surface of the first member is coated in a painted on a portion of the inner surface of the first member below the first convex portion, and the inner surface of the first member does not include a coat of paint on a portion of the inner surface of the first member below the first concave portion so that a heat absorptivity in an inner surface of the first convex portion is higher than a heat absorptivity in an inner surface of the first concave portion.

13. The fixing device according to claim 1, wherein the inner surface of the first member includes a first coat portion and a second coat portion, the first coat portion is painted at the inner surface of the first member below the first convex portion, the second coat portion is painted at the inner surface of the first member below the first concave portion, and a thickness of the first coat portion is greater than a thickness of the second coat portion.

14. The fixing device according to claim 1, wherein the inner surface of the first member includes a first coat portion and a second coat portion, the first coat portion is painted at the inner surface of the first member below the first convex portion, the second coat portion is painted at the inner surface of the first member below the first concave portion, and the first coat portion and the second coat portion include different kinds of paints.

15. A fixing device that fixes a toner image in place on a recording medium, the fixing device comprising:

a cylindrical first member extending along a first longitudinal axis, a thickness of an external circumferential surface of the first member varying along the first longitudinal axis to define at least one first convex portion curving outward and at least one first concave portion curving inward with respect to the first longitudinal axis, a thickness of the first convex portion being larger than a thickness of the first concave portion;

a second member extending along a second longitudinal axis parallel to the first longitudinal axis, a thickness of an external circumferential surface of the second member varying along the second longitudinal axis to define at least one second convex portion curving outward and at least one second concave portion curving inward with respect to the second longitudinal axis, at least one of the first and second members being pressed against the other of the first and second members, with the first convex portion engaging the second concave portion and the first concave portion engaging the second convex portion, to define a fixing nip therebetween through which the recording medium is passed to fix the toner image under heat and pressure; and a heating source disposed in the first member to heat the first member, wherein, when the heating source heats the first member, a temperature of an inner circumference side of the first convex portion is higher than a temperature of an inner circumference side of the first concave portion, wherein the first member includes a heat shield component configured to shield a portion of the heat generated by of the heating source, and wherein the heat shield component is arranged between an inner surface of the first member and the heating source so that an amount of the heat shield located at the inner surface of the first member below the first convex portion is smaller than an amount of the heat shield located at the inner surface of the first member below the first concave portion.

16. A fixing device that fixes a toner image in place on a recording medium, the fixing device comprising:

a cylindrical first member extending along a first longitudinal axis, a thickness of an external circumferential surface of the first member varying along the first longitudinal axis to define at least one first convex portion curving outward and at least one first concave portion curving inward with respect to the first longitudinal axis, a thickness of the first convex portion being larger than a thickness of the first concave portion;

a second member extending along a second longitudinal axis parallel to the first longitudinal axis, a thickness of an external circumferential surface of the second member varying along the second longitudinal axis to define at least one second convex portion curving outward and at least one second concave portion curving inward with respect to the second longitudinal axis, at least one of the first and second members being pressed against the other of the first and second members, with the first convex portion engaging the second concave portion and the first concave portion engaging the second convex portion, to define a fixing nip therebetween through which the recording medium is passed to fix the toner image under heat and pressure; and a heating source disposed in the first member to heat the first member, wherein, when the heating source heats the first member, a temperature of an inner circumference side of the first convex portion is higher than a temperature of an inner circumference side of the first concave portion, wherein the first member comprises an internally heated fuser roller rotatable around the first longitudinal axis, and the second member comprises a stationary pressure member pressed against the fuser roller through an endless, fixing belt looped for rotation around the pressure member, and wherein the first member and the second member are mounted in the fixing device with a first end secured so as to be fixed with respect to an axial direction of the first and second members, and a second end displaceable in the axial direction of the first and second members.

* * * * *